US009190795B2

(12) United States Patent
Johnson

(10) Patent No.: US 9,190,795 B2
(45) Date of Patent: Nov. 17, 2015

(54) METHOD OF TERMINATING A PLURALITY OF WIRES TO AN ELECTRICAL CONNECTOR

(71) Applicant: Onanon, Inc., Milpitas, CA (US)

(72) Inventor: Dennis J. Johnson, Milpitas, CA (US)

(73) Assignee: Onanon, Inc., Milpitas, CA (US)

( * ) Notice: Subject to any disclaimer, the term of this patent is extended or adjusted under 35 U.S.C. 154(b) by 204 days.

(21) Appl. No.: 14/060,852

(22) Filed: Oct. 23, 2013

(65) Prior Publication Data

US 2015/0107103 A1 Apr. 23, 2015

(51) Int. Cl.
*H01R 43/02* (2006.01)
*H01R 4/02* (2006.01)

(52) U.S. Cl.
CPC ..... *H01R 43/0235* (2013.01); *H01R 43/0249* (2013.01); *H01R 4/024* (2013.01); *Y10T 29/49179* (2015.01)

(58) Field of Classification Search
CPC .... H01R 4/723; H01R 4/024; H01R 43/0235; H01R 43/0249; H01R 4/187; Y10T 29/49174; Y10T 29/49179; Y10T 29/49149; Y10T 29/49169; Y10T 29/49181; Y10T 29/49195; Y10T 29/49144
USPC ..... 29/592.1, 830, 832, 841, 848, 854, 856, 29/858, 876, 883; 264/104; 439/79, 86, 439/91.66, 488, 491, 567, 591, 597, 607.1
See application file for complete search history.

(56) References Cited

U.S. PATENT DOCUMENTS

| | | | | | |
|---|---|---|---|---|---|
| 5,098,319 | A * | 3/1992 | McGaffigan et al. | ..... | 439/874 |
| 5,163,856 | A * | 11/1992 | McGaffigan et al. | ..... | 439/874 |
| 5,225,066 | A * | 7/1993 | Drew | ..... | 205/85 |
| 5,393,932 | A * | 2/1995 | Young et al. | ..... | 174/84 R |
| 6,086,413 | A * | 7/2000 | Karasik et al. | ..... | 439/516 |
| 6,269,539 | B1 * | 8/2001 | Takahashi et al. | ..... | 29/883 |
| 6,730,848 | B1 * | 5/2004 | Antaya et al. | ..... | 174/78 |
| 7,011,553 | B2 * | 3/2006 | Hayashi et al. | ..... | 439/752 |
| 7,318,730 | B2 * | 1/2008 | Miyazaki | ..... | 439/83 |
| 2008/0155823 | A1 | 7/2008 | Heinzel | | |
| 2009/0023339 | A1 * | 1/2009 | Kameyama et al. | ..... | 439/609 |
| 2011/0113626 | A1 | 5/2011 | Ng | | |

FOREIGN PATENT DOCUMENTS

| | | |
|---|---|---|
| JP | 2012084686 | 4/2012 |
| KR | 200291242 | 10/2002 |

OTHER PUBLICATIONS

PCT International Search Report and Written Opinion of the International Searching Authority; Printed on Jul. 30, 2015.

* cited by examiner

*Primary Examiner* — Paul D Kim
(74) *Attorney, Agent, or Firm* — Michael S. Neustel

(57) ABSTRACT

A method of terminating a plurality of wires to an electrical connector. The method generally includes providing a heat applicator device that selectively applies heat to a specific connector pin within an electrical connector so that a corresponding wire may be soldered to the connector pin. The heat applicator device applies heat to a first connector pin for a period of time for soldering of a first wire to the first connector pin and then the heat is removed. The heat applicator device then applies heat to the next connector pin for soldering a next wire to the next connector with the process continuing until all of the wires are soldered to their corresponding connector pins on the electrical connector.

20 Claims, 35 Drawing Sheets

METHOD OF TERMINATING A PLURALITY OF WIRES TO AN ELECTRICAL CONNECTOR

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to wire termination and more specifically it relates to a wire termination system for efficiently connecting a plurality of wires to an electrical connector.

2. Description of the Related Art

Any discussion of the related art throughout the specification should in no way be considered as an admission that such related art is widely known or forms part of common general knowledge in the field.

There are various types of electrical connectors used today including but not limited to fine wire terminations, pinned connectors, terminal blocks, plug and socket connectors, medical connectors, transition devices and custom connectors. Conventional electrical connectors include a plurality of connector pins that have a corresponding plurality of wires from a cable that must be soldered together according to a pinout which cross-references the wires to the connector pins. Today, technicians manually connect each individual wire to a corresponding connector pin on the electrical connector. The number of connector pins on a connector range from 2 to greater than 100 connector pins which receive a corresponding number of wires.

Medical probes typically have numerous connector pins within an electrical connector that require a corresponding number of fine wires to be connected to. For example, modern catheters may contain more than 120 40-gauge wires connecting medical transducers. A skilled technician manually connects each of the fine wires to a corresponding connector pin on the electrical connector utilizing a soldering device (e.g. soldering iron or soldering gun). The technician must identify a fine wire and a corresponding connector pin where the fine wire will be connected to. After identifying the proper connection point for the fine wire, the technician then must position the fine wire adjacent to the connector pin and then heats the solder with the soldering device to melt upon both the fine wire and the connector pin. Once the technician removes the soldering device, the melted solder solidifies thereby physically and electrically connecting the fine wire to the connector pin. The technician manually repeats this process for each individual fine wire until all of the fine wires are connected.

As can be appreciated, the manual process of soldering a plurality of wires to an electrical connector is labor intensive, time consuming, costly and creates a significant amount of discarded material. Errors by technicians soldering wires to electrical connectors are common with error rates approaching 25% with some medical connectors where the wires are very thin and where a single mistake typically results in the complete loss of the connector. For example, technicians may mistakenly connect a wire to an incorrect connector pin thereby resulting in a defective electrical connector being produced thereby requiring additional time to fix or the complete loss of the electrical connector. Errors by technicians are further compounded by the increasingly smaller wires used in electrical connectors today, particularly in the medical industry, where some devices require 100 or more connector pins within a square centimeter. To make matters worse for technicians, they must often times connect extremely fine wires having a 40-gauge or 50-gauge size.

Because of the inherent problems with conventional wire termination systems, there is a need for a new and improved wire termination system for efficiently connecting a plurality of wires to an electrical connector.

BRIEF SUMMARY OF THE INVENTION

The invention generally relates to a wire termination system which includes a heat applicator device that selectively applies heat to a specific connector pin within an electrical connector so that a corresponding wire may be soldered to the connector pin. The heat applicator device applies heat to a first connector pin for a period of time for soldering of a first wire to the first connector pin and then the heat is removed. The heat applicator device then applies heat to the next connector pin for soldering a next wire to the next connector with the process continuing until all of the wires are soldered to their corresponding connector pins on the electrical connector.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1A:
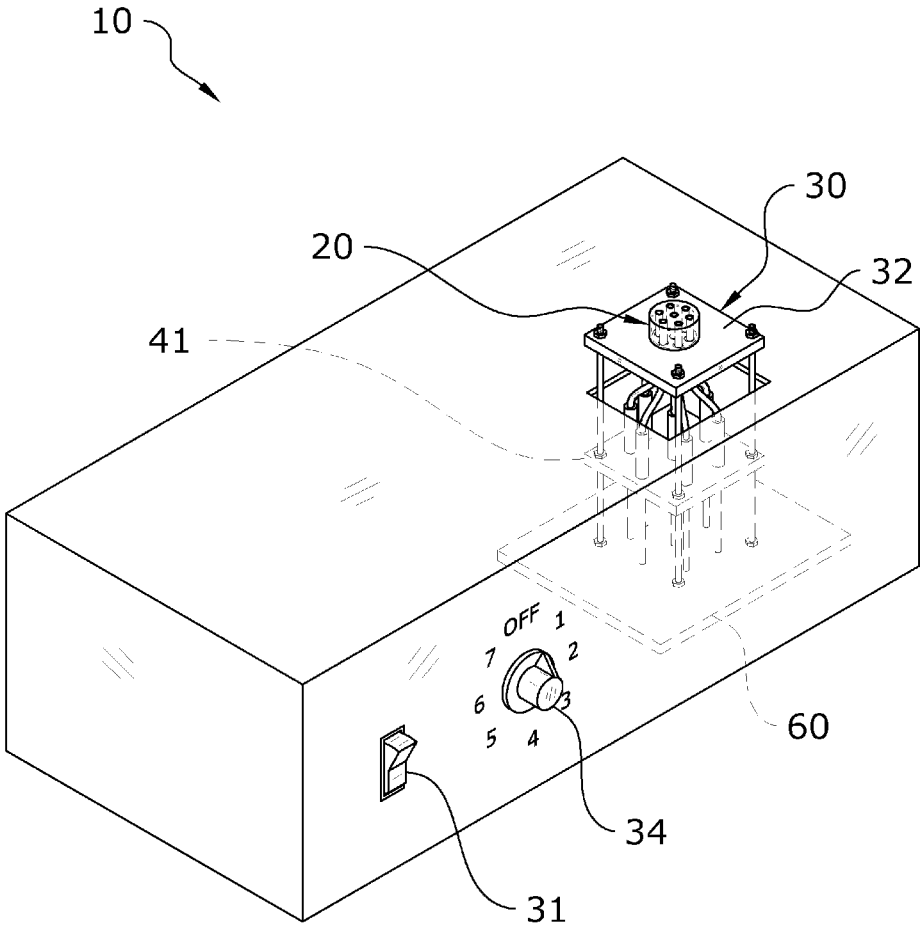
FIG. 1*a* is an upper perspective view of the present invention with an electrical connector positioned within the heat unit.

A. Overview of Invention.

FIGS. 1 through 18 illustrate the present invention comprised of the wire termination system 10. The wire termination system 10 generally includes a heat applicator device 30 that selectively applies heat to a specific connector pin within an electrical connector 20 so that a corresponding wire may be soldered to the connector pin. The heat applicator device 30 applies heat to a first connector pin for a period of time for soldering of a first wire to the first connector pin and then the heat is removed. The heat applicator device 30 then applies heat to the next connector pin for soldering a next wire to the next connector with the process continuing until all of the wires 16*a-g* are soldered to their corresponding connector pins 23*a-g* on the electrical connector 20.

B. Electrical Connector.

The electrical connector 20 may be comprised of any device where electrical wires 16*a-g* are terminated at. There are various types of electrical connectors 20 used today including but not limited to fine wire terminations, pinned connectors, terminal blocks, plug and socket connectors, medical connectors, transition devices and custom connectors. The electrical connector 20 may be for various types of industries such as but not limited to the medical industry.

As illustrated in FIGS. 1*b* through 4 of the drawings, the electrical connector 20 includes a plurality of connector pins 23*a-g* that extend through an insulator housing 22. The connector pins 23*a-g* are comprised of an electrical conductive material such as metal. The insulator housing 22 electrically insulates the respective connector pins 23*a-g* and also supports the connector pins 23*a-g*. The insulator housing 22 may have various shapes (e.g. circular as illustrated in FIGS. 3*b* and 3*c*), thicknesses and sizes.

The connector pins 23*a-g* are typically parallel with one another and may form various types of shapes and patterns. Also, the number of connector pins 23*a-g* on a connector may range from 2 connector pins 23*a-g* to greater than 100 connector pins 23*a-g*.

Figure 2:
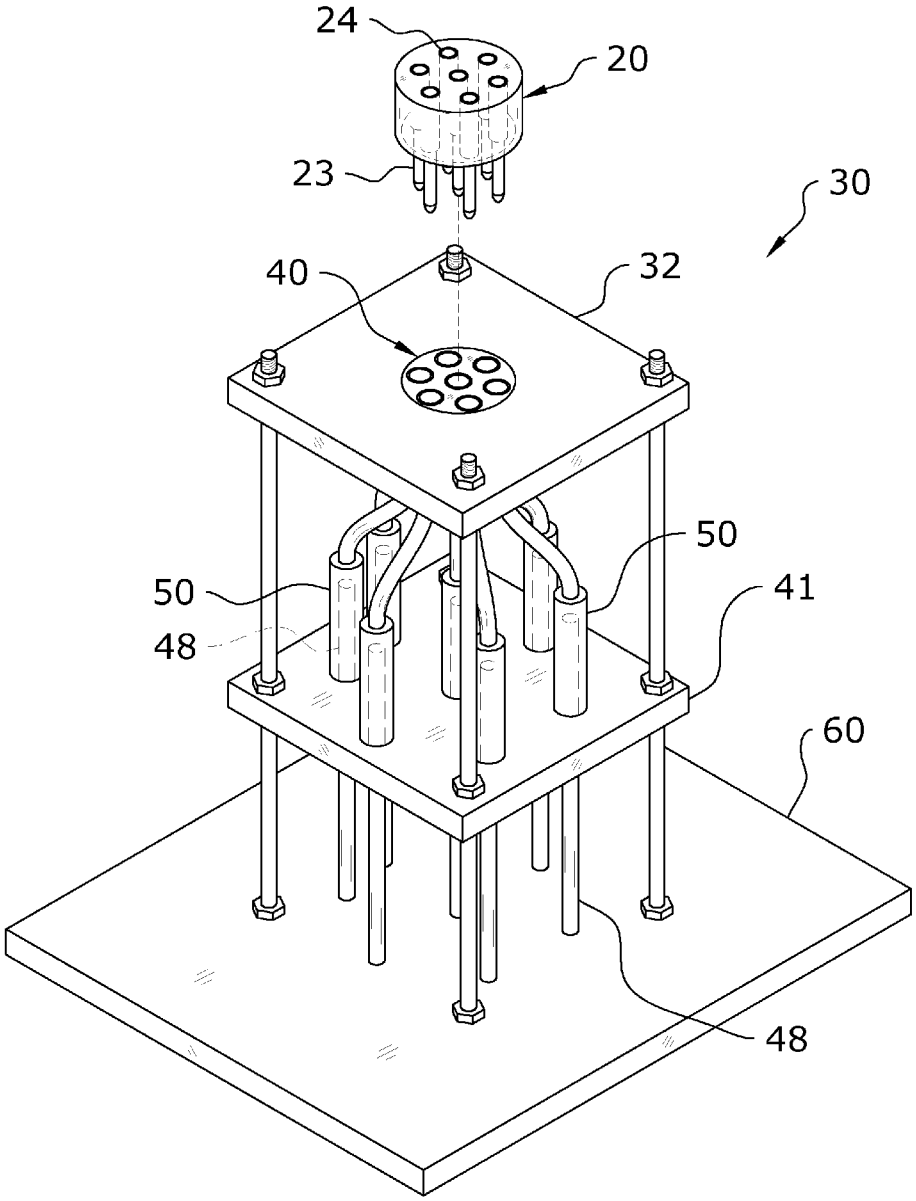
FIG. 2 is an upper perspective view of the heat unit with the electrical connector removed.
Figure 3A:
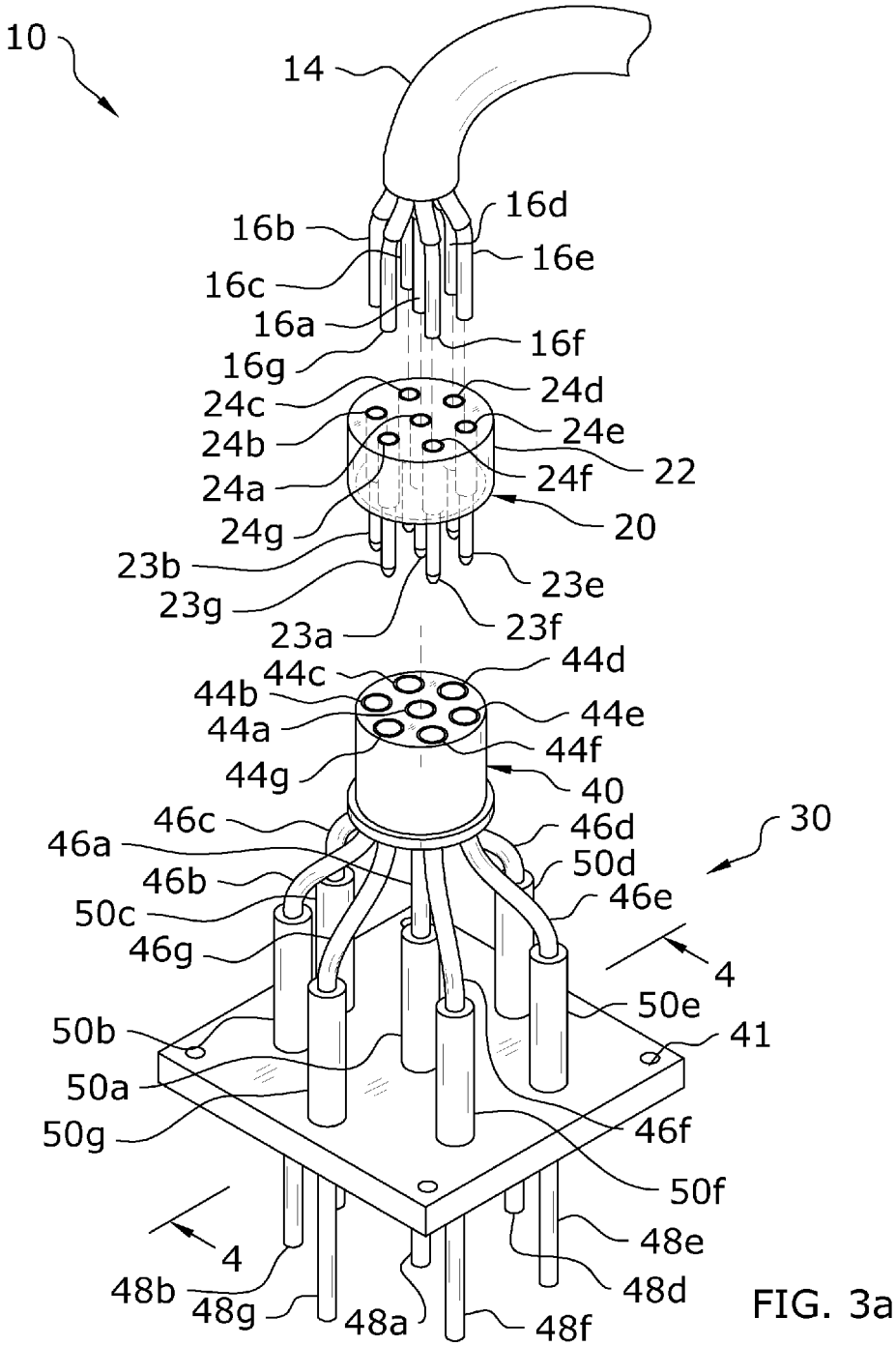
FIG. 3*a* is an exploded upper perspective view of the heat applicator device, the electrical connector and the wires of a cable to be connected to the connector pins within the electrical connector.
Figure 3B:
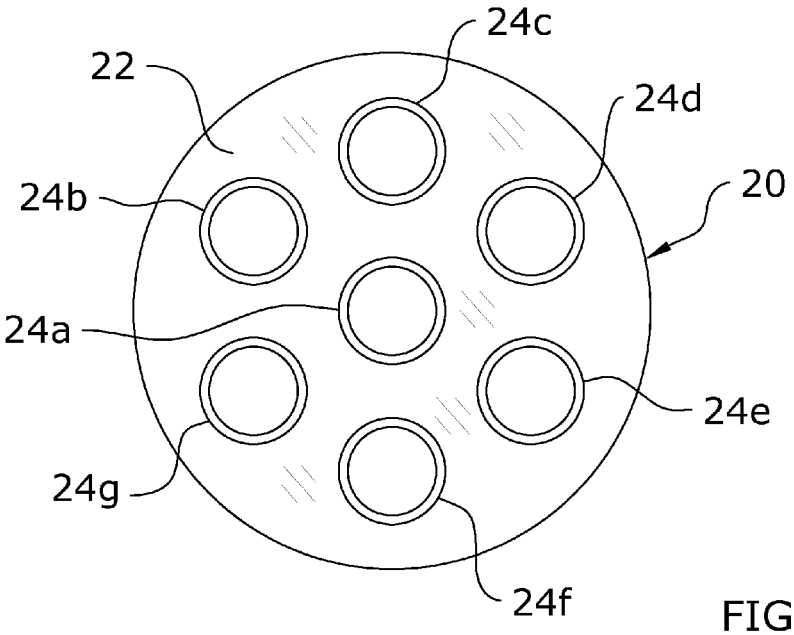
FIG. 3*b* is a top view of an exemplary electrical connector.
Figure 3C:
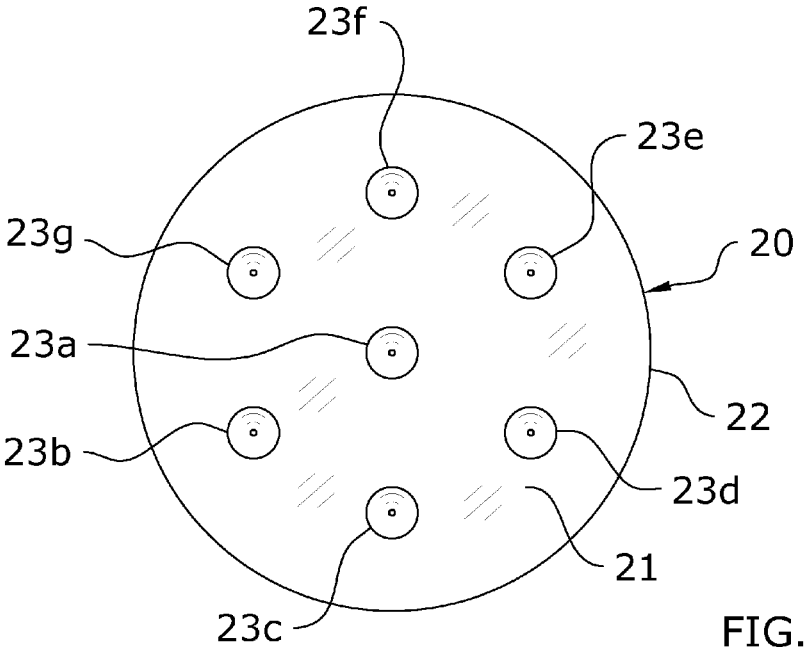
FIG. 3*c* is a bottom view of an exemplary electrical connector.
Figure 4:
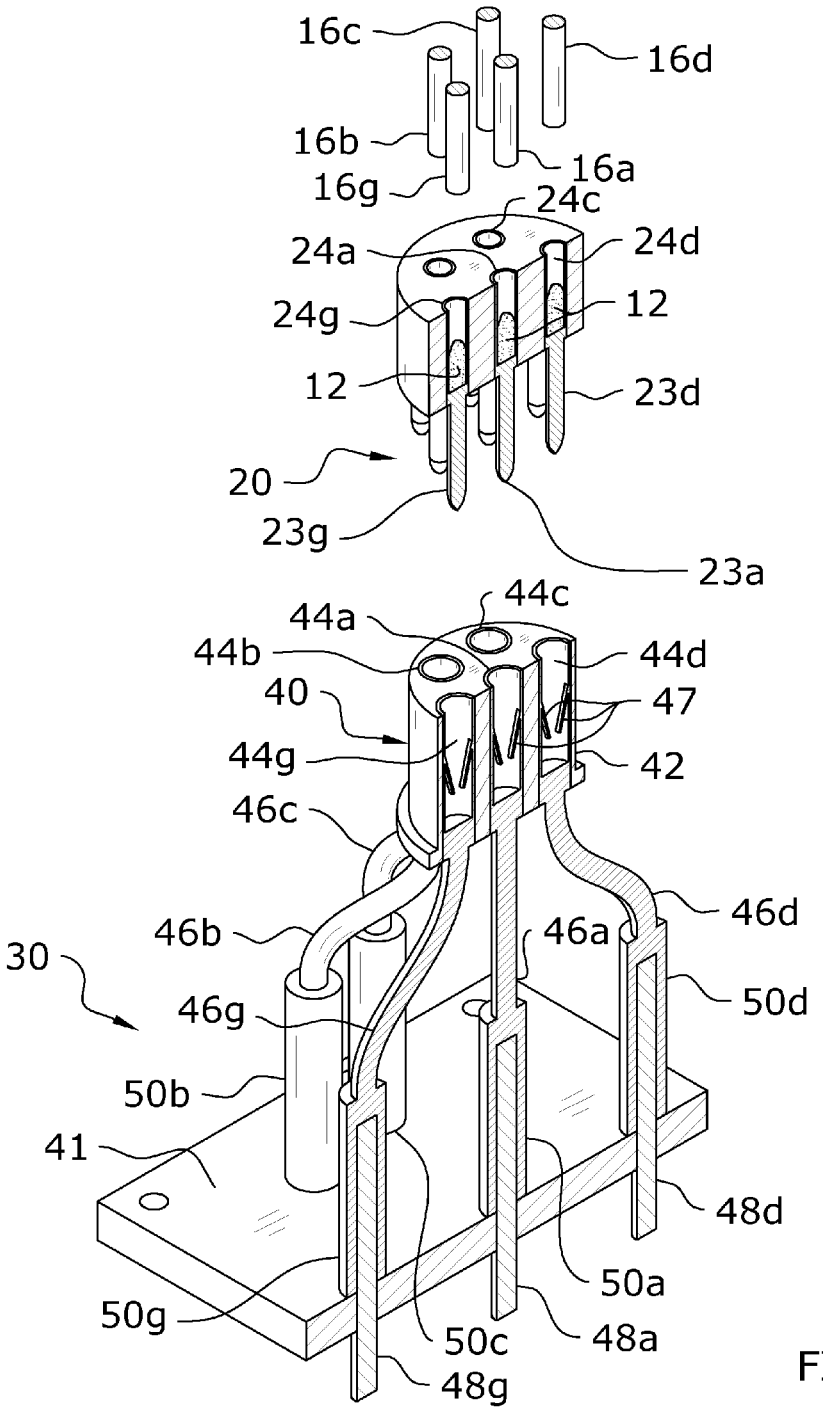
FIG. 4 is a cross sectional view taken along line 4-4 of FIG. 3*a*.

The connector pins 23*a-g* have a male connecting end that typically has a tapered end or pointed end used to electrically connect the electrical connector 20 to a corresponding electrical socket or the like as best illustrated in FIGS. 3*a* and 3*c* of the drawings. The connecting end typically is comprised of a solid pin structure as illustrated in FIG. 4 of the drawings. The male connecting end of the connector pins 23*a-g* extends outwardly from a first side of the insulator housing 22 as illustrated in FIGS. 2, 3*a* and 4 of the drawings.

The connector pins 23*a-g* each include a corresponding connector receptacle 24*a-g* that is positioned opposite of the male connecting end of the connector pins 23*a-g*. The distal ends of the wires 16*a-g* are soldered to the connector receptacles 24*a-g* according to a pinout to form a physical and electrical connection between the same.

Figure 5A:
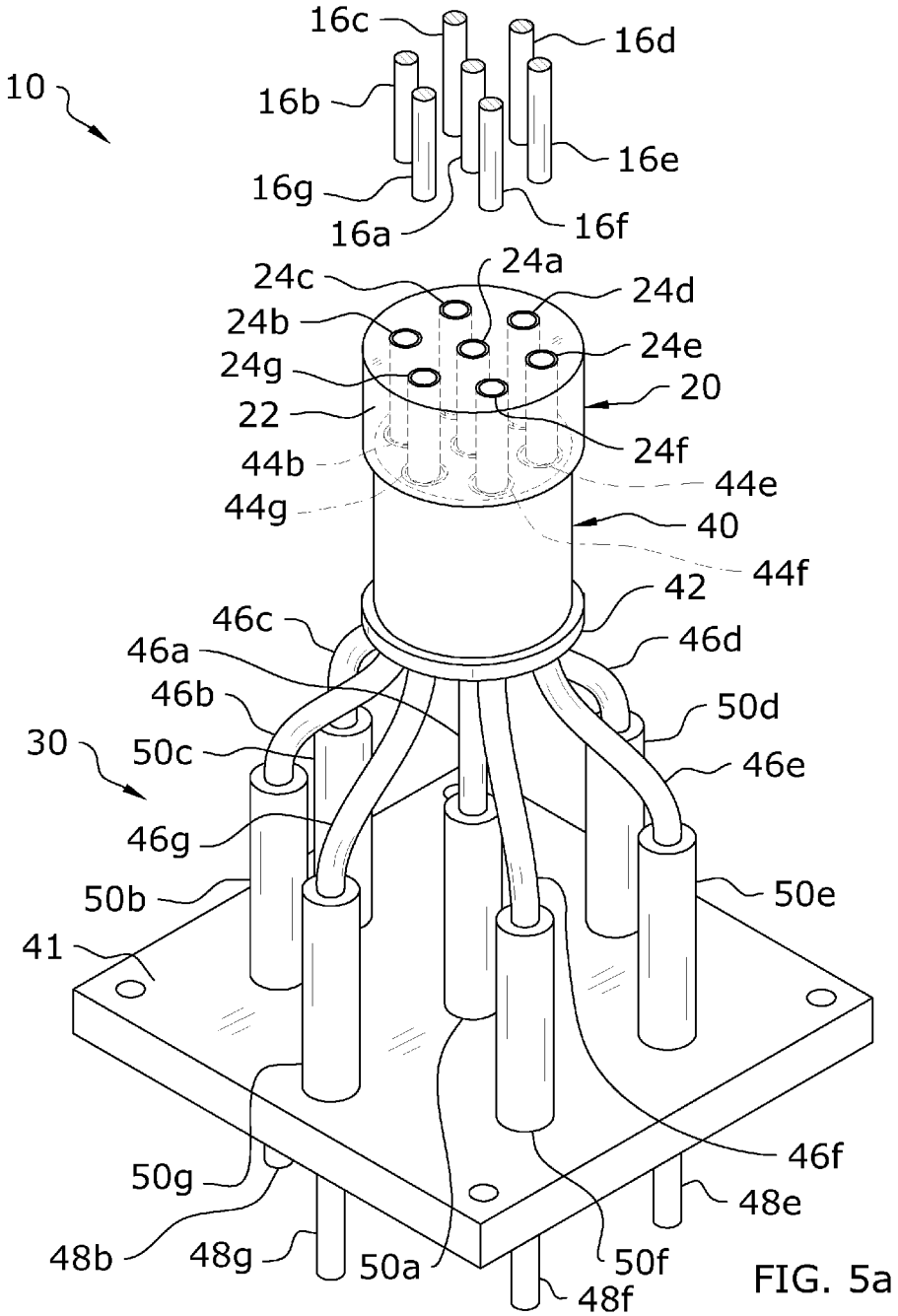
FIG. 5*a* is an upper perspective view with the electrical connector positioned upon the heat unit.

FIGS. 3*a*, 3*b* and 4 illustrate a preferred embodiment of the connector receptacles 24*a-g* comprised of a female connecting end having a tubular structure. The connector receptacles 24*a-g* may have a non-tubular structure as long as the connector receptacles 24*a-g* allow for the soldering of the wires 16*a-g*. The connector receptacles 24*a-g* preferably extend outwardly from a second side of the insulator housing 22 of the electrical connector 20 which is opposite of the first side. The connector receptacles 24*a-g* preferably have an upper opening that may be flush with, recessed or extending past the second side of the insulator housing 22 of the electrical connector 20 as best illustrated in FIG. 4 of the drawings. The connector receptacles 24*a-g* may all extend the same distance from the second side of the electrical connector 20 as illustrated in FIGS. 3*a* and 5*a* of the drawings or the connector receptacles 24*a-g* may extend outwardly from the second side at different distances (e.g. central located receptacles may extend outwardly further than outer located receptacles).

The connector receptacles 24*a-g* are preferably prefilled with a solder 12 prior to attaching the electrical connector 20 to the heat applicator device 30 or applying heat to any of the connector pins 23*a-g*. For example, the interior cavity of the connector receptacles 24*a-g* may be at least partially filled with solder 12 balls. The prefilling of the connector receptacles 24*a-g* with solder 12 allows for the electrical connector 20 to be positioned within the heat applicator device 30 and heat to be selectively applied to the connector pins 23*a-g* without the operator having to manually apply solder 12 to secure the wires 16*a-g* to the connector receptacles 24*a-g*.

Various types of solder 12 may be utilized such as but not limited to lead solder 12, lead-free solder 12, solder 12 balls, solder 12 paste and flux-core solder 12. The solder 12 may be comprised of various fusible metal alloys that have a relatively low melting point capable of physically and electrically connecting the wires 16*a-g* to the connector pins 23*a-g* of the electrical connector 20.

C. Cable and Wires.

FIG. 3*a* illustrates a cable 14 with a plurality of wires 16*a-g* extending from the tubular insulation of the cable 14. It can be appreciated that the wires 16*a-g* to be connected to the electrical connector 20 do not have to be part of an insulated cable 14 and instead may be separate of one another without a common sheathing. The wires 16*a-g* may have various lengths and sizes.

The plurality of wires 16*a-g* from the cable 14 are soldered to the respective connector pins 23*a-g* according to a pinout which cross-references the wires 16*a-g* to the corresponding connector pins 23*a-g*. The pinout may be a diagram or chart used to reference the specific connector pins 23*a-g* and corresponding wires 16*a-g*. The pinout may be color coded, numbered or otherwise coded to assist a technician in positioning the wires 16*a-g* adjacent to and upon their respective connector pins 23*a-g* for proper connection of the wires 16*a-g* to the connector pins 23*a-g*. Incorrect connection of any wire to the electrical connector 20 can result in the complete loss of the electrical connector 20.

D. Heat Applicator Device.

FIGS. 1*a* through 5*h* and 9 illustrate an exemplary heat applicator device 30 utilized to apply heat to the individual connector pins 23*a-g* sufficient to melt the solder 12 (e.g. 190 degrees F. or greater) into a liquid state and thereby resulting in the soldering of the wires 16*a-g* to the connector pins 23*a-g*. The heat applicator device 30 may be a portable device or a non-movable fixture.

The heat applicator device 30 includes a power switch 31 that a user uses to turn the heat applicator device 30 on/off as illustrated in FIG. 1*a* of the drawings. The heat applicator device 30 further preferably includes a control switch 34 that the technician manipulates to control which connector pin 23*a-g* is heated and for how long.

Figure 1B:
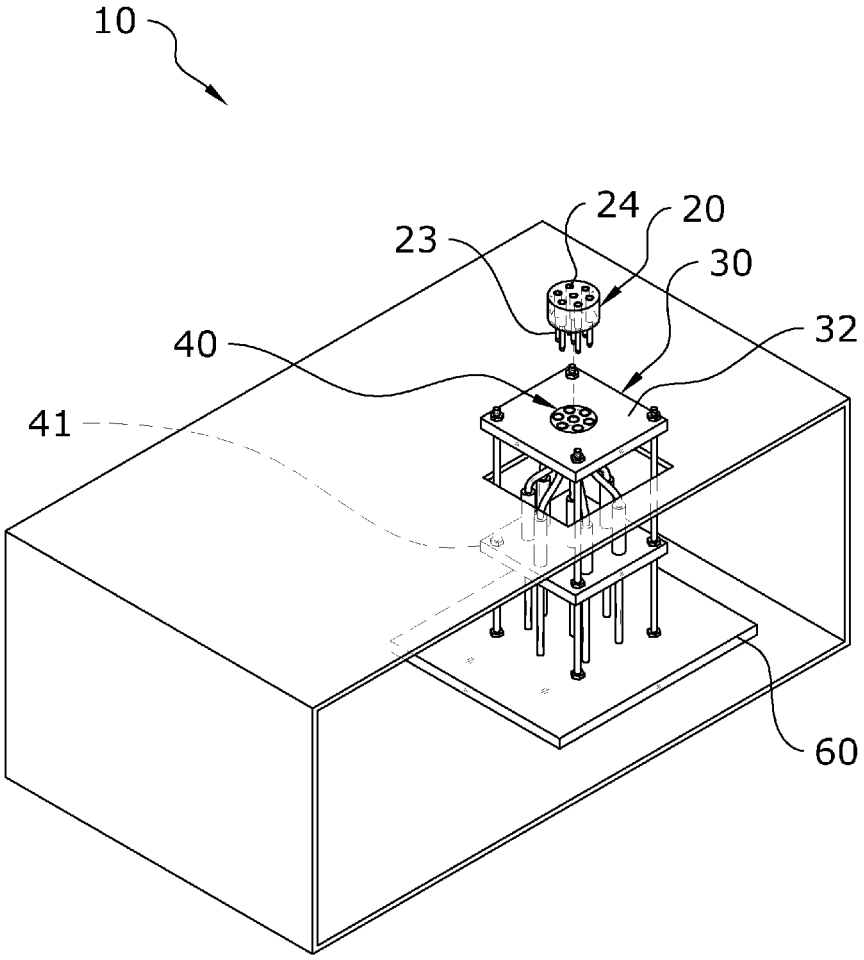
FIG. 1*b* is an upper perspective view of the present invention with a portion of the housing removed and the electrical connector removed from the heat unit.
Figure 18:
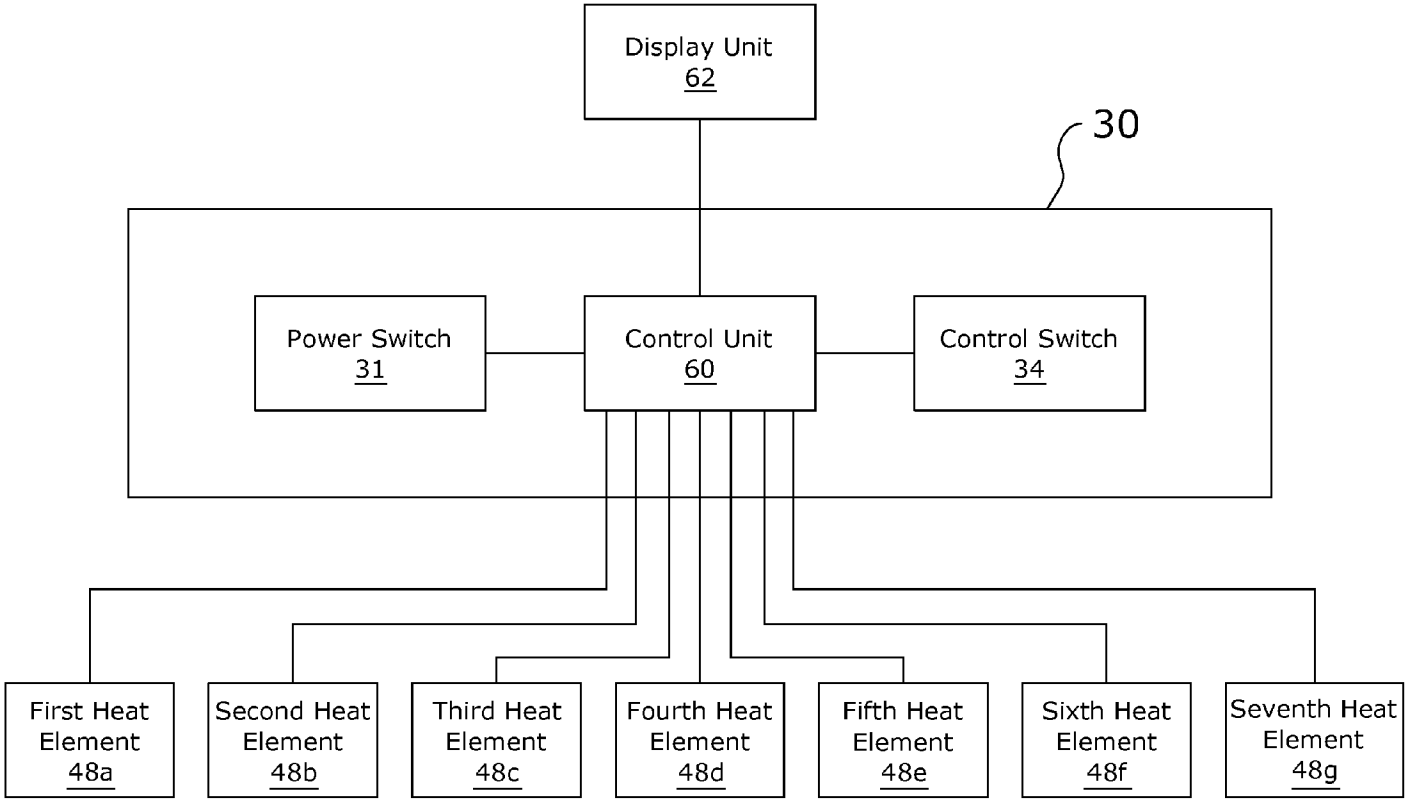
FIG. 18 is a block diagram illustrating the control unit in communication with the display unit and the heat applicator device.

As illustrated in FIGS. 1*a* through 2 of the drawings, the heat applicator device 30 is comprised of an upper support member 32 (e.g. platform) that supports a heating unit 40 that the electrical connector 20 physically and thermally connects to. The heat applicator device 30 further is comprised of a lower support member 41 that supports the heat elements 48*a-g*. The upper support member 32 and the lower support member 41 preferably are comprised of a heat resistant material. The upper support member 32 is supported above the lower support member 41 with a plurality of support members extending between the upper support member 32 and the lower support member 41. The heat elements 48*a-g* are electrically connected to the heat applicator device 30 and the control unit 60 as illustrated in FIGS. 1*b*, 2 and 18 of the drawings.

The heat elements 48*a-g* used in the present invention are comprised of any device capable of generating heat sufficient to melt solder 12 such as but not limited to ceramic heating elements. The heat elements 48*a-g* may generate heat via electricity or other heating option. The heat elements 48*a-g* pass through the lower support member 41 and upwardly as best illustrated in FIG. 4 of the drawings.

Figure 10A:
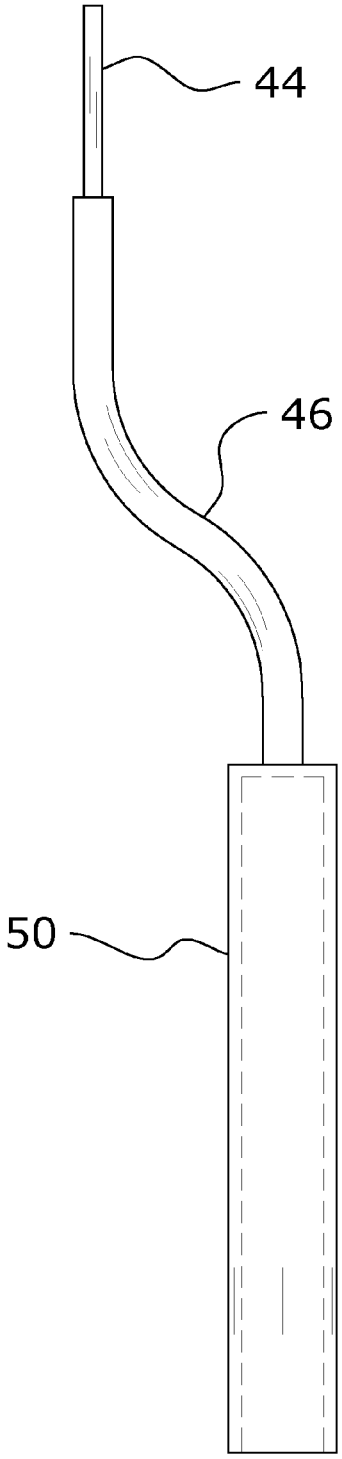
FIG. 10*a* is a side view of a heat conductor thermally connected between a tubular thermal connector and a heat receptacle.
Figure 10B:
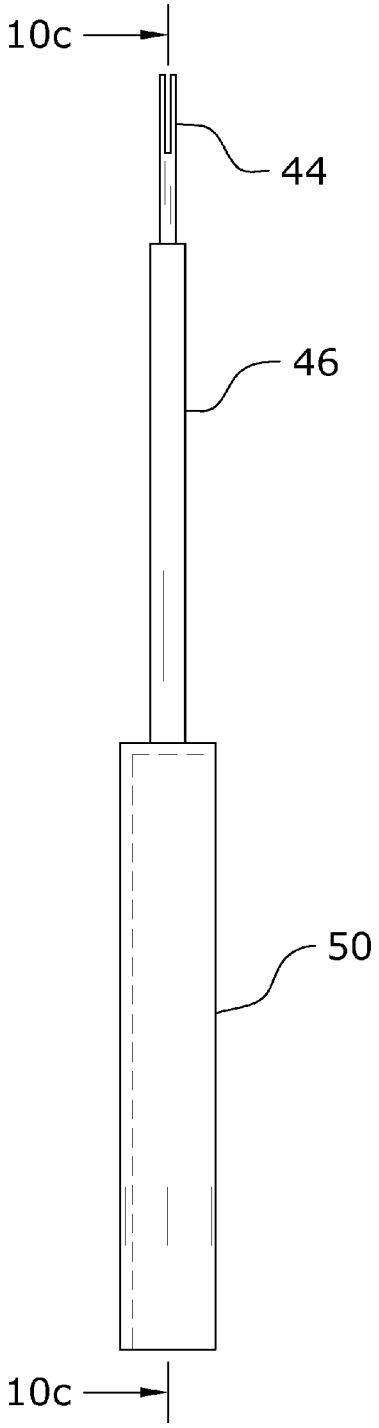
FIG. 10*b* is front view of the heat conductor thermally connected between the tubular thermal connector and the heat receptacle.
Figure 10C:
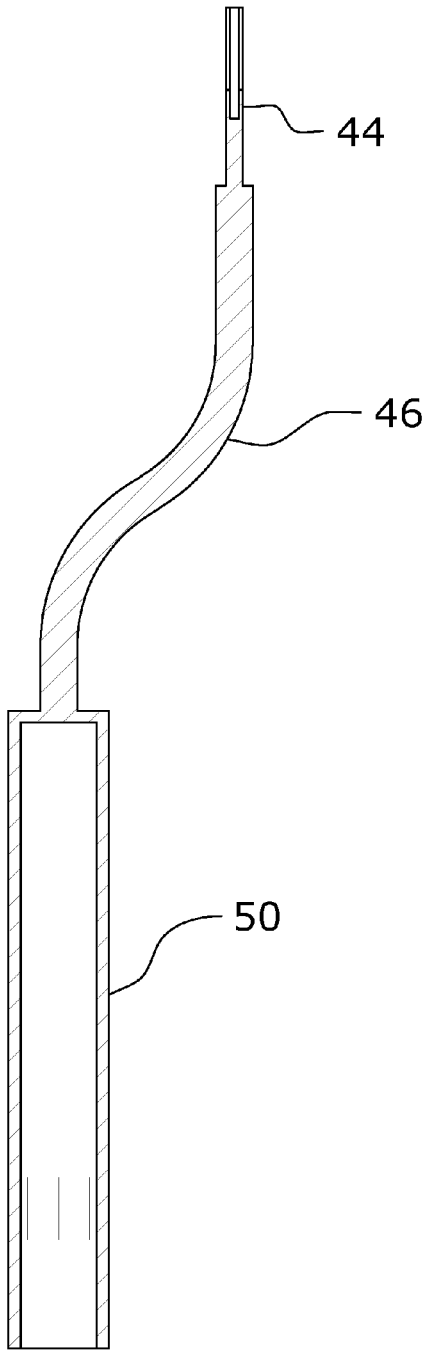
FIG. 10*c* is a cross sectional view taken along line 10*c*-10*c* of FIG. 10*b*.
Figure 11A:
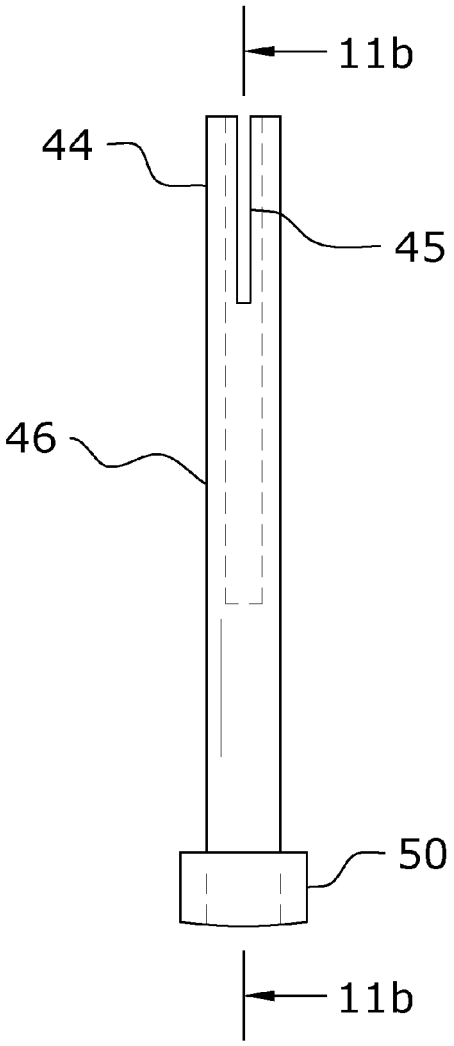
FIG. 11*a* is a side view of a heat receptacle.
Figure 11B:
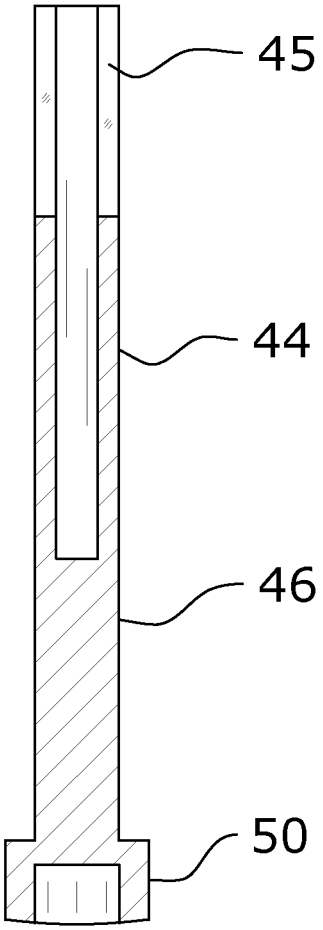
FIG. 11*b* is a cross sectional view taken along line 11*b*-11*b* of FIG. 11*a*.

A corresponding plurality of thermal connectors 50*a-g* are in thermal contact with the heat elements 48*a-g* to conduct the heat generated by the heat elements 48*a-g*. The thermal connectors 50*a-g* are preferably comprised of a heat conductive metal such as copper. The thermal connectors 50*a-g* are further preferably comprised of a tubular structure that snugly surrounds the heat elements 48*a-g* to increase the surface area contact with the heat elements 48*a-g* as best illustrated in FIGS. 4 and 10*c* of the drawings.

A plurality of heat conductors 46*a-g* are physically and thermally connected to the thermal connectors 50*a-g* as shown in FIGS. 2, 3*a*, 4 and 5*a* of the drawings. The heat conductors 46*a-g* are also preferably comprised of a heat conductive metal such as copper to transfer the heat conducted by the thermal connectors 50*a-g* to the heat receptacles 44*a-g* within the heating unit 40. The heat conductors 46*a-g* are further preferably comprised of an elongated bendable structure to allow for forming of the path of the heat conductors 46*a-g* to fit with the heating unit 40 of the heat applicator device 30. FIGS. 2, 3*a*, 4 and 5*a* best illustrate how the heat conductors 46*a-g* are bent inwardly toward the lower end of the heating unit 40 to thermally connect to corresponding heat receptacles 44*a-g* within the heating unit 40. This allows for larger sized heating elements and thermal connectors 50*a-g* to be used while providing the flexibility required to create the desired pattern of heat receptacles 44*a-g* within the heating unit 40 to match smaller sized electrical connectors 20.

The heat receptacles 44*a-g* are physically and thermally connected to the heat conductors 46*a-g* opposite of the thermal connectors 50*a-g* as illustrated in FIG. 4 of the drawings. Each of the heat receptacles 44*a-g* is preferably connected to only one of the heat conductors 46*a-g*. The heat receptacles 44*a-g* are preferably comprised of a heat conductive metal such as copper to effectively transfer the heat from the heat conductors 46*a-g* to the connector pins 23*a-g* of the electrical connector 20 positioned within the heating unit 40. The plurality of heat receptacles 44*a-g* are each preferably concentrically aligned with a corresponding connector pin of the plurality of connector pins 23*a-g*.

The heat receptacles 44*a-g* preferably are comprised of a tubular structure adapted to receive the connector pins 23*a-g* of the electrical connector 20. The heat receptacles 44*a-g* may have various cross sectional shapes such as circular, square, rectangular or oval. The heat receptacles 44*a-g* may be comprised of a non-tubular structure (e.g. flat, concave, etc.). The heating unit 40 further preferably includes an insulated housing 42 that the heat receptacles 44*a-g* are positioned within, however, the heat receptacles 44*a-g* may also be directly positioned within the upper support member 32.

The pattern for the heat receptacles 44*a-g* matches the pattern of the connector pins 23*a-g* so that the electrical connector 20 may be connected to the heating unit 40 by the connector pins 23*a-g*. As can be appreciated, the heat receptacles 44*a-g* within the heating unit 40 may be comprised of any type of pattern and any number. For example, FIG. 3*a* illustrates seven heat receptacles 44*a-g* within the heating unit 40 with a center heat receptacle 44*a* surrounded in a circular pattern by the other receptacles 44*b-g*. It is preferable that the heat receptacles 44*a-g*, the corresponding heat conductors 46*a-g* and the corresponding thermal connectors 50*a-g* are each comprised of a unitary structure without any thermal barriers comprised of the same material such as metal (e.g. copper) as best illustrated in FIGS. 4 and 10*c* of the drawings.

Figure 12A:
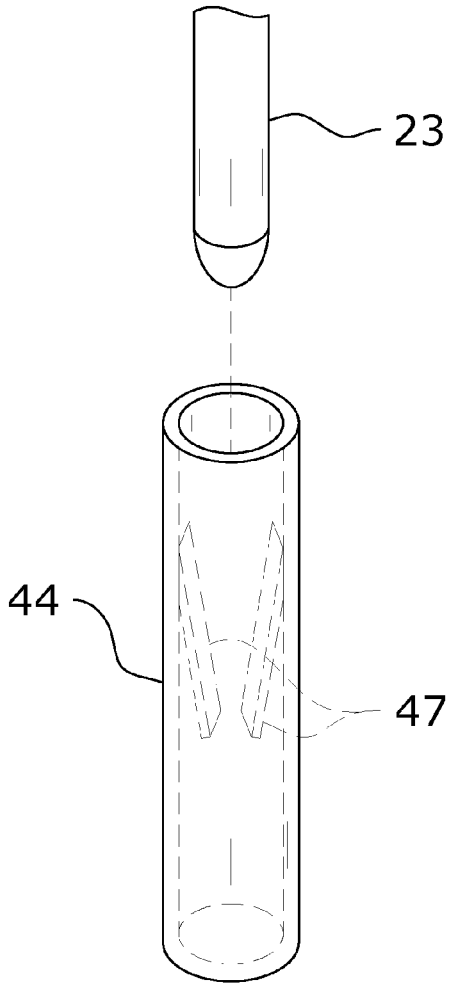
FIG. 12*a* is an exploded upper perspective view of a heat receptacle with contact clips.
Figure 12B:
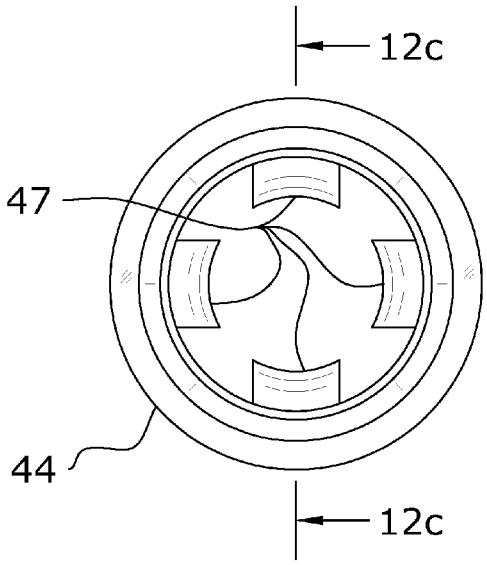
FIG. 12*b* is an end view of a heat receptacle having a plurality of contact clips.
Figure 12C:
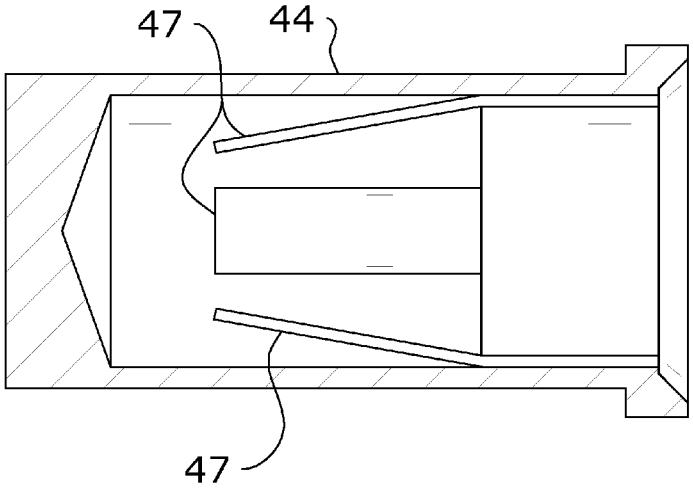
FIG. 12*c* is a cross sectional view taken along line 12*c*-12*c* of FIG. 12*b*.

The heat receptacles 44*a-g* may have a tubular structure wherein the interior passage of the heat receptacles 44*a-g* is slightly larger than the outer diameter/width of the connector pins 23*a-g* to allow for physical engagement of the connector pins 23*a-g* by the interior surface of the heat receptacles 44*a-g*. In addition, the heat receptacles 44*a-g* may include one or more contact clips 47 that extend inwardly from the interior wall of the heat receptacles 44*a-g* as illustrated in FIGS. 2 through 8*c*, 12*a*, 12*b* and 12*c*. The distal ends and/or the cross sectional shape of the contact clips 47 may also have an inwardly curved structure to increase the surface contact of the contact clips 47 with the connector pins 23*a*-g as best illustrated in FIG. 12*b* of the drawings. The contact clips 47 are preferably angled downwardly away from the opening of the heat receptacles 44*a-g* as illustrated in FIG. 4 of the drawings. When the connector pins 23*a-g* are inserted into the heat receptacles 44*a-g*, the contact clips 47 flex towards the inner wall of each of the heat receptacles 44*a-g* while ensuring a constant thermal connection with each of the connector pins 23*a-g* of the electrical connector 20.

Figure 15:
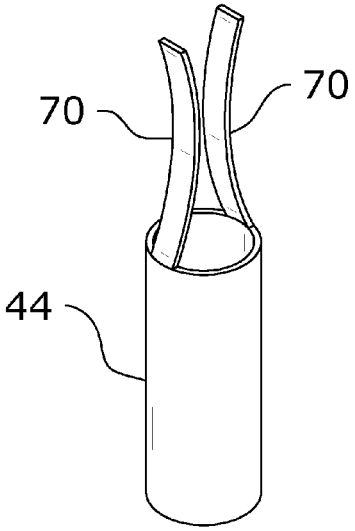
FIG. 15 is an upper perspective view of a heat receptacle having a pair of prongs.
Figure 16:
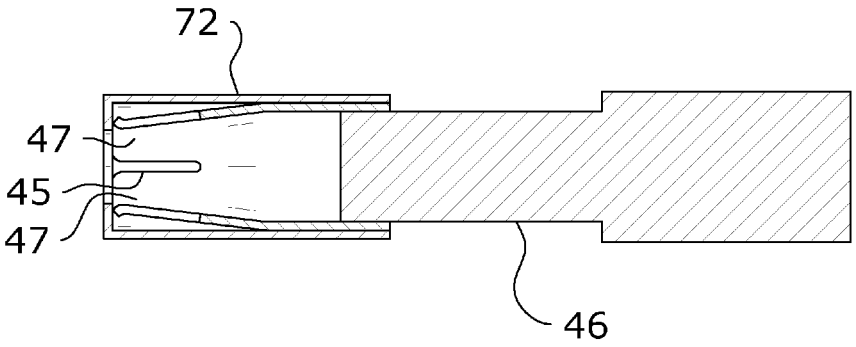
FIG. 16 is a side cross sectional view of another variation of the heat receptacle having contact clips and a hood.

As a related embodiment, the contact clips 47 may be connected to a tubular structure that is positioned over the heat conductor 46 with a hood 72 having a concentric opening positioned over the contact clips 47 as illustrated in FIG. 16. As another related embodiment, FIG. 15 illustrates a pair of prongs 70 extending outwardly from the heat receptacle instead of using contact clips 47 within the interior of the heat receptacle.

Figure 13A:
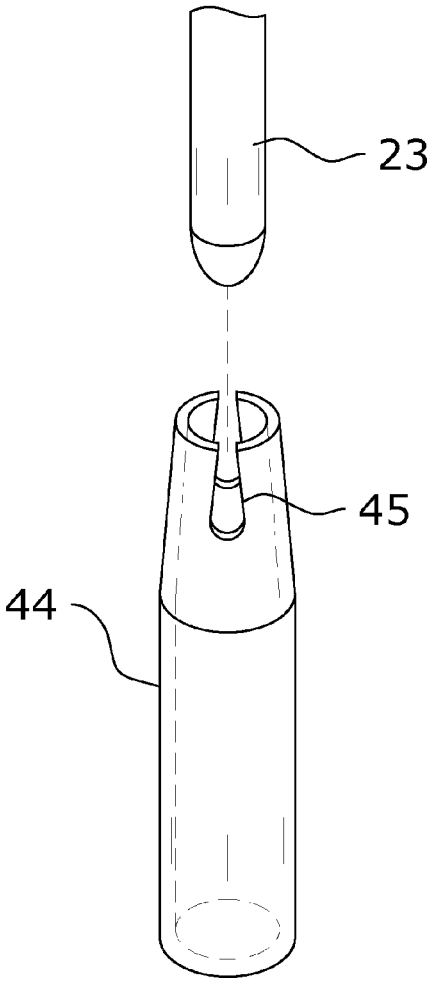
FIG. 13*a* is an upper perspective view of another variation of the heat receptacle.
Figure 13B:
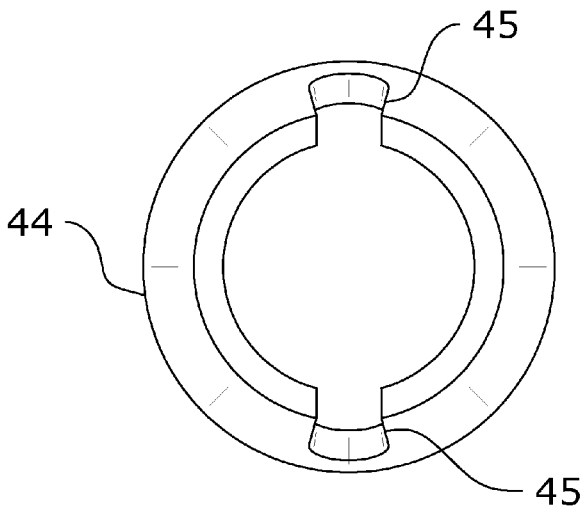
FIG. 13*b* is an end view of the variation of the heat receptacle shown in FIG. 13*a*.
Figure 13C:
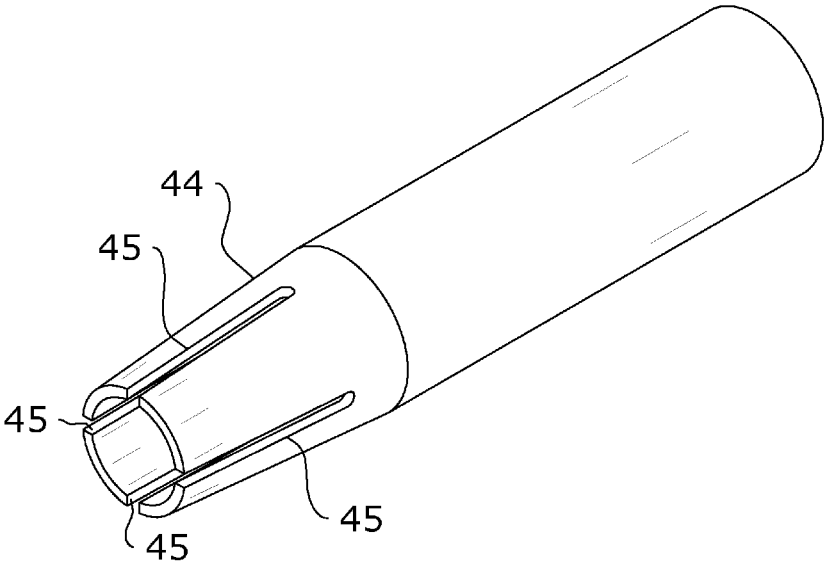
FIG. 13*c* is an upper perspective view of the variation of the heat receptacle shown in FIG. 13*a* with additional cutouts.

FIGS. 10*a* through 11*b* illustrate an alternative heat receptacle 44 in thermal communication with the heat conductor 46, wherein the heat conductor is in thermal communication with the corresponding thermal connector. The heat receptacle 44 illustrated in FIGS. 10*a* through 11*b* and 13*a* through 13*c* includes one or more cutouts 45 that extend longitudinally within the tubular structure of the heat receptacle thereby allowing the distal portion of the heat receptacle 44 to physically and thermally engage the outer surface of the connector pin while providing sufficient expansion of the heat receptacle. The distal portion of the heat receptacle 44 may be straight as shown in FIGS. 10*a* through 11*b* or tapered inwardly as illustrated in FIGS. 13*a* through 13*c*. The cutouts 45 preferably only extend partially along the length of the heat receptacle 44 from the distal end thereof, however, the cutouts 45 may extend along the entire length of the heat receptacle 44.

Figure 14:
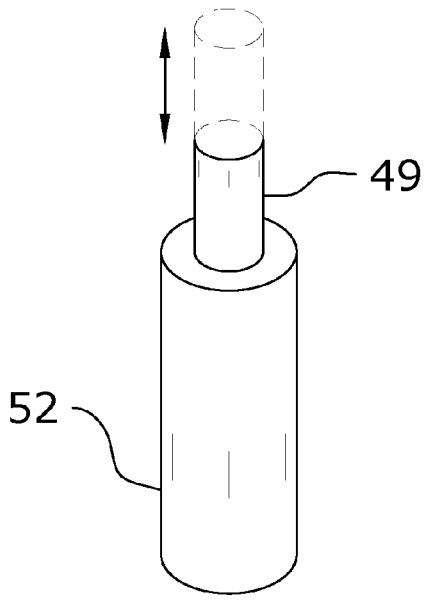
FIG. 14 is an upper perspective view of a heat device having a telescoping pin.

FIG. 14 illustrates wherein the heat receptacles 44*a-g* are comprised of heat devices 52 having a pogo-pin structure that utilizes a telescoping pin 49 that is biased upwardly and that physically engages the connector pin. Each of the heat receptacles 44*a-g* is comprised of the structure of the heat device 52 and are positioned beneath the connector pins 23*a-g* of the electrical connector 20 to ensure direct physical and thermal contact for each of the connector pins 23*a-g* despite any difference in length for the connector pins 23*a-g*.

Figure 9:
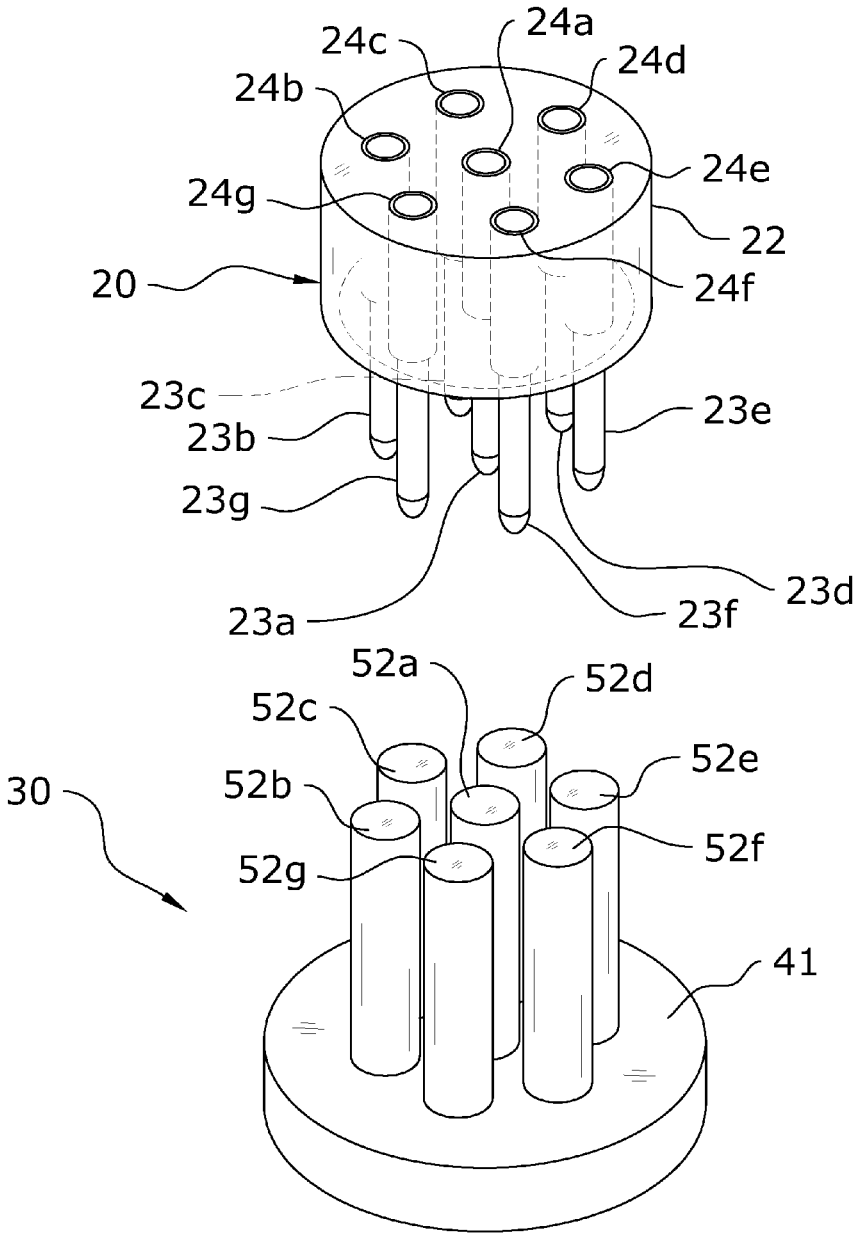
FIG. 9 is an upper perspective view of a plurality of heat devices that apply heat to selected connector pins of the electrical connector from a distance without direct physical contact.

FIG. 9 illustrates a plurality of heat devices 52 that do not physically connect with the connector pins 23*a-g* but direct heat to specific opposing connector pins 23*a-g*. For example, the heat devices 52 may be comprised of a laser (e.g. nitrogen laser) that directs laser light to a specific one of the connector pins 23*a-g* to heat the same.

E. Control Unit.

The control unit 60 may be comprised of any type of circuit board or computer for practicing the various aspects of the present invention. For example, the control unit 60 can be a personal computer (e.g. APPLE® based computer, an IBM based computer, or compatible thereof) or tablet computer (e.g. IPAD®). The control unit 60 may also be comprised of various other electronic devices capable of sending and receiving electronic data including but not limited to smartphones, mobile phones, telephones, personal digital assistants (PDAs), mobile electronic devices, handheld wireless devices, smart phones and video viewing units.

The control unit 60 controls the operation of the present invention. In particular, the control unit 60 controls which of the heat elements 48*a-g* is turned on or off. The control unit 60 is in communication with a power switch 31 which turns the present invention on/off as illustrated in FIG. 18. The control unit 60 further is preferably in communication with a control switch 34 which allows the user to manually control which of the heat elements 48*a-g* is activated to produce heat.

FIG. 1*a* illustrates an exemplary control switch 34 comprised of a turn-knob electrical switch having a plurality of positions that each represent the activation of one of the heat elements 48*a-g* and an off position. For example, FIG. 1*a* illustrates 8 positions for the control switch 34: OFF, 1, 2, 3, 4, 5, 6 and 7. Position "Off" deactivates electrical power to all of the heat elements 48*a-g*, position 1 activates the first heat element 48*a*, position 2 activates the second heat element 48*b*, position 3 activates the third heat element 48*c*, position 4 activates the fourth heat element 48*d*, position 5 activates the fifth heat element 48*e*, position 6 activates the sixth heat element 48*f* and position 7 activates the seventh heat element 48*g*. As can be appreciated, the number of positions for the control switch 34 corresponds to the number of heat elements 48*a-g* to be controlled.

The control switch 34 may also be comprised of a toggle device or a foot pedal that simply advances the heating of the heat elements 48*a-g* each time the control switch 34 is depressed. For example, in the initial state the control unit 60 is off until the user depresses the control switch 34 which then activates the first heat element 48*a*. When the user releases the control switch 34, the first heat element 48*a* is deactivated. When the user depresses the control switch 34*a* second time, the second heat element 48*b* is activated and when the user thereafter releases the control switch 34 the second heat element 48 is deactivated and so forth until all of the heat elements 48*a-g* have been activated to heat the corresponding connector pins 23*a-g*.

Instead of operating manually via a control switch 34, the control unit 60 may operate automatically by automatically controlling which of the heat elements 48*a-g* are activated. For example, the control unit 60 may automatically activate the first heat element 48*a* for a period of time (e.g. 5 seconds) and/or until a specific temperature is reached sufficient to heat the corresponding heat receptacle sufficiently to melt the solder 12 within the corresponding connector receptacle and allow the technician to insert the corresponding first wire 16*a* into the first connector receptacle 24*a*. After the period of time, the control unit 60 automatically deactivates the first heat element 48*a* and then automatically activates the second heat element 48*b* for a period of time and/or a specific temperature is reached similar to the first heat element and then deactivates the second heat element 48*b* after a period of time. This process continues for the remaining heat elements 48*a-g* until all of the wires 16*a-g* are fully inserted and connected within the electrical connector 20. It is preferable that visual and/or audio indicators are provided to the technician indicating when to insert a specific wire 16*a-g* into a corresponding connector receptacle 24*a-g*.

Various sensors may be in communication with the control unit 60 such as but not limited to temperature sensors that detect the temperature of the heat elements 48*a-g*, the thermal connectors 50*a-g*, the heat conductors 46*a-g*, the heat receptacles 44*a-g*, the connector pins 23*a-g*, the connector receptacles 24*a-g*, solder 12 within the connector receptacles 24*a-g* and/or the wires 16*a-g*. The control unit 60 may use the data received by the sensors in controlling the operation of the present invention and may display the same on the display unit 62.

The control unit 60 is further preferably in communication with a display unit 62 (e.g. display screen or monitor) to display various types of information. For example, the control unit 60 may display the following types of information on the display unit 62: status of the heat applicator device 30 (e.g. On, Off), the position of the control switch 34, an indication of which connector pin is being heated, the connector pin within the electrical connector 20 that has heat applied thereto, a graphical representation of the connector pin having heat applied thereto, a graphical representation of a selected wire for the technician to insert into a selected heated connector pin, the amount of time heat has been applied to a connector pin, the temperature of a heat receptacle, the temperature of a connector pin and the like.

The control unit 60 may be comprised of any conventional computer or similar electronic device. A conventional computer preferably includes a printer, a hard disk drive, a network interface, and a keyboard. A conventional computer also includes a microprocessor, a memory bus, random access memory (RAM), read only memory (ROM), a peripheral bus, and a keyboard controller. The microprocessor is a general-purpose digital processor that controls the operation of the computer. The microprocessor can be a single-chip processor or implemented with multiple components. Using instructions retrieved from memory, the microprocessor controls the reception and manipulations of input data and the output and display of data on output devices. The memory bus is utilized by the microprocessor to access the RAM and the ROM. RAM is used by microprocessor as a general storage area and as scratch-pad memory, and can also be used to store input data and processed data. ROM can be used to store instructions or program code followed by microprocessor as well as other data. A peripheral bus is used to access the input, output and storage devices used by the computer. In the described embodiments, these devices include a display screen, a printer device, a hard disk drive, and a network interface. A keyboard controller is used to receive input from the keyboard and send decoded symbols for each pressed key to microprocessor over bus. The keyboard is used by a user to input commands and other instructions to the computer system. Other types of user input devices can also be used in conjunction with the present invention. For example, pointing devices such as a computer mouse, a track ball, a stylus, or a tablet to manipulate a pointer on a screen of the computer system. The display screen is an output device that displays images of data provided by the microprocessor via the peripheral bus or provided by other components in the computer. The printer device when operating as a printer provides an image on a sheet of paper or a similar surface. The hard disk drive can be utilized to store various types of data. The microprocessor together with an operating system operate to execute computer code and produce and use data. The computer code and data may reside on RAM, ROM, or hard disk drive. The computer code and data can also reside on a removable program medium and loaded or installed onto computer system when needed. Removable program mediums include, for example, CD-ROM, PC-CARD, USB drives, floppy disk and magnetic tape. The network interface circuit is utilized to send and receive data over a network connected to other computer systems. An interface card or similar device and appropriate software implemented by microprocessor can be utilized to connect the computer system to an existing network and transfer data according to standard protocols.

F. Operation of Present Invention.

Figure 17:
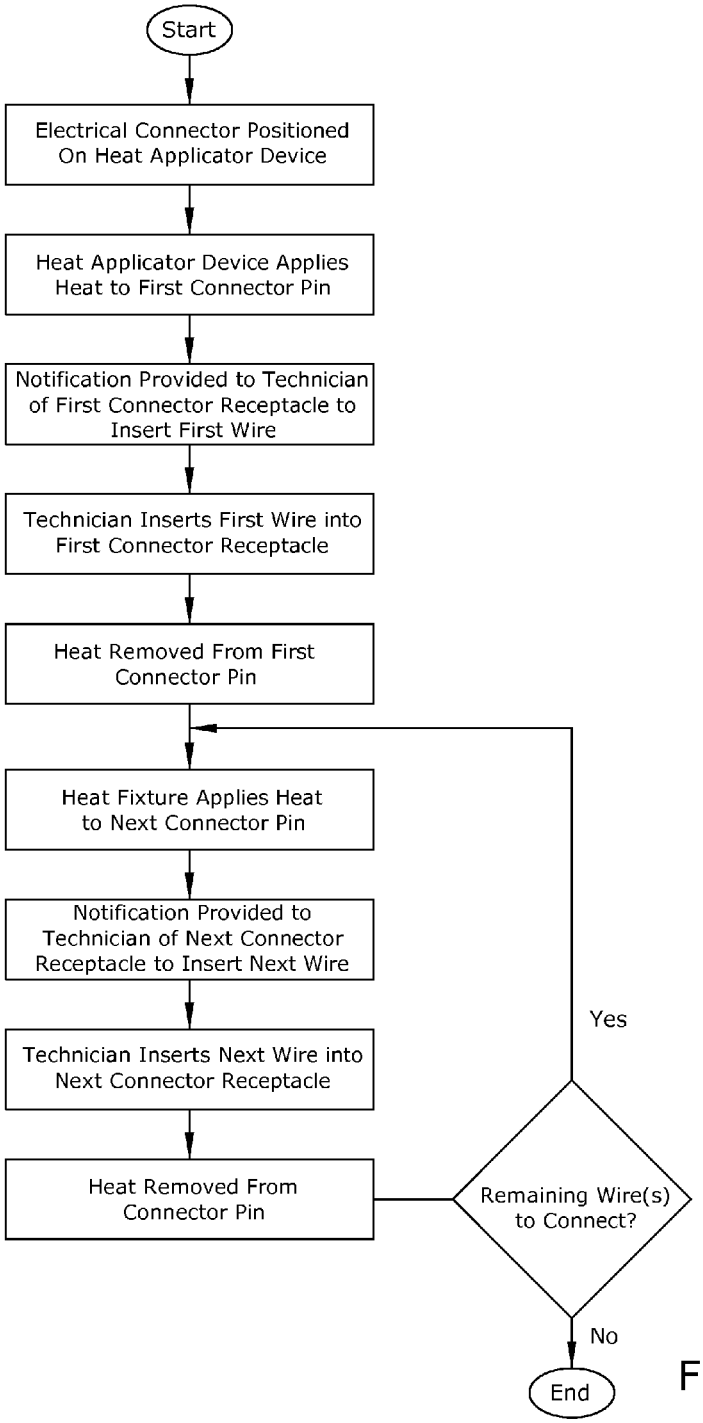
FIG. 17 is a flowchart illustrating the overall functionality of the present invention.

FIG. 17 provides an overview of the present invention. As illustrated in FIGS. 1*a* and 5*a* of the drawings, the technician first connects the electrical connector 20 to the heat applicator device 30 by inserting the connector pins 23*a-g* into the heat receptacles 44*a-g* of the heating unit 40. Once the electrical connector 20 is properly connected to the heat applicator device 30, the user then turns on the heat applicator device 30.

Figure 5B:
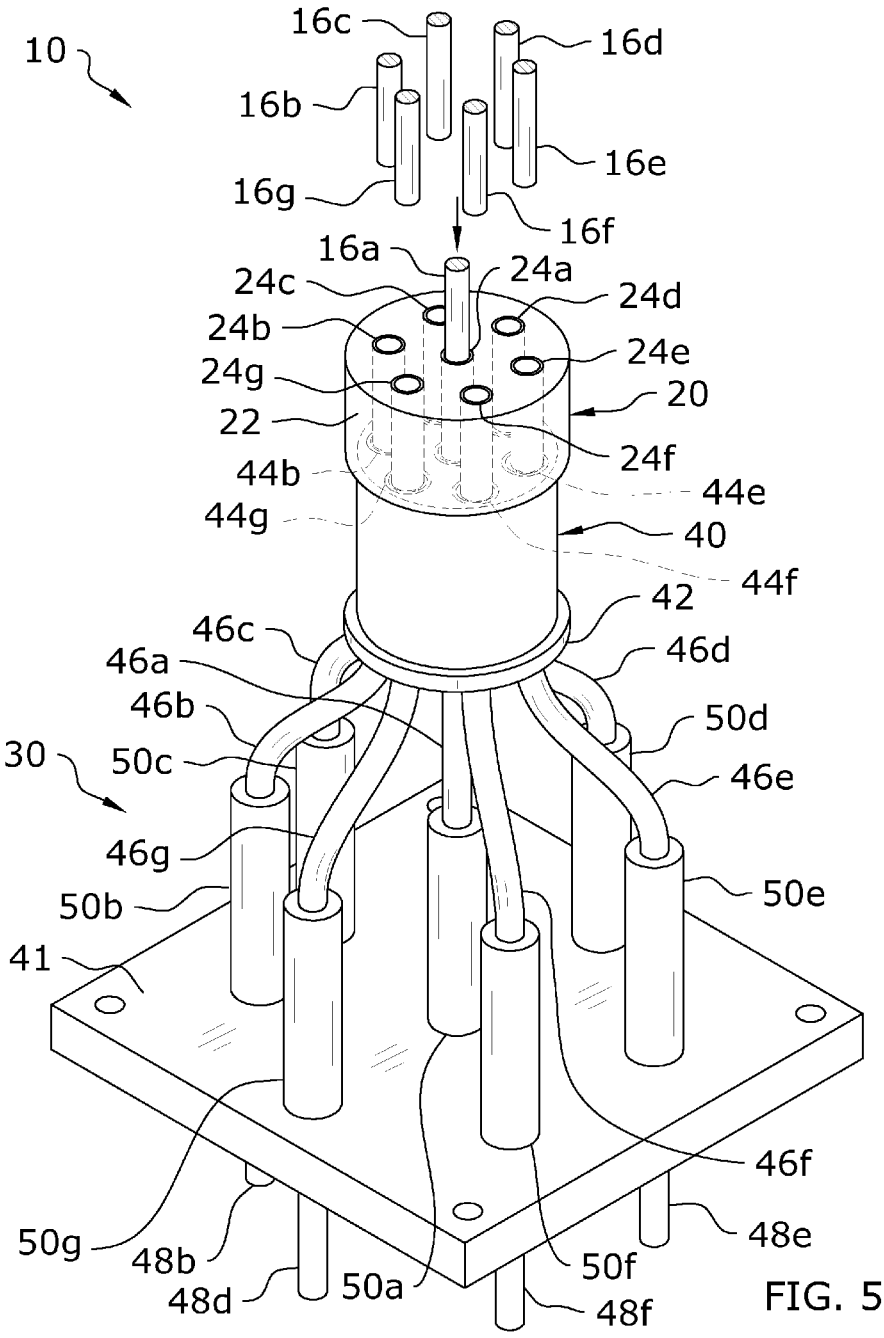
FIG. 5*b* is an upper perspective view of the electrical connector positioned upon the heat unit with a first wire inserted into a first connector receptacle.
Figure 5C:
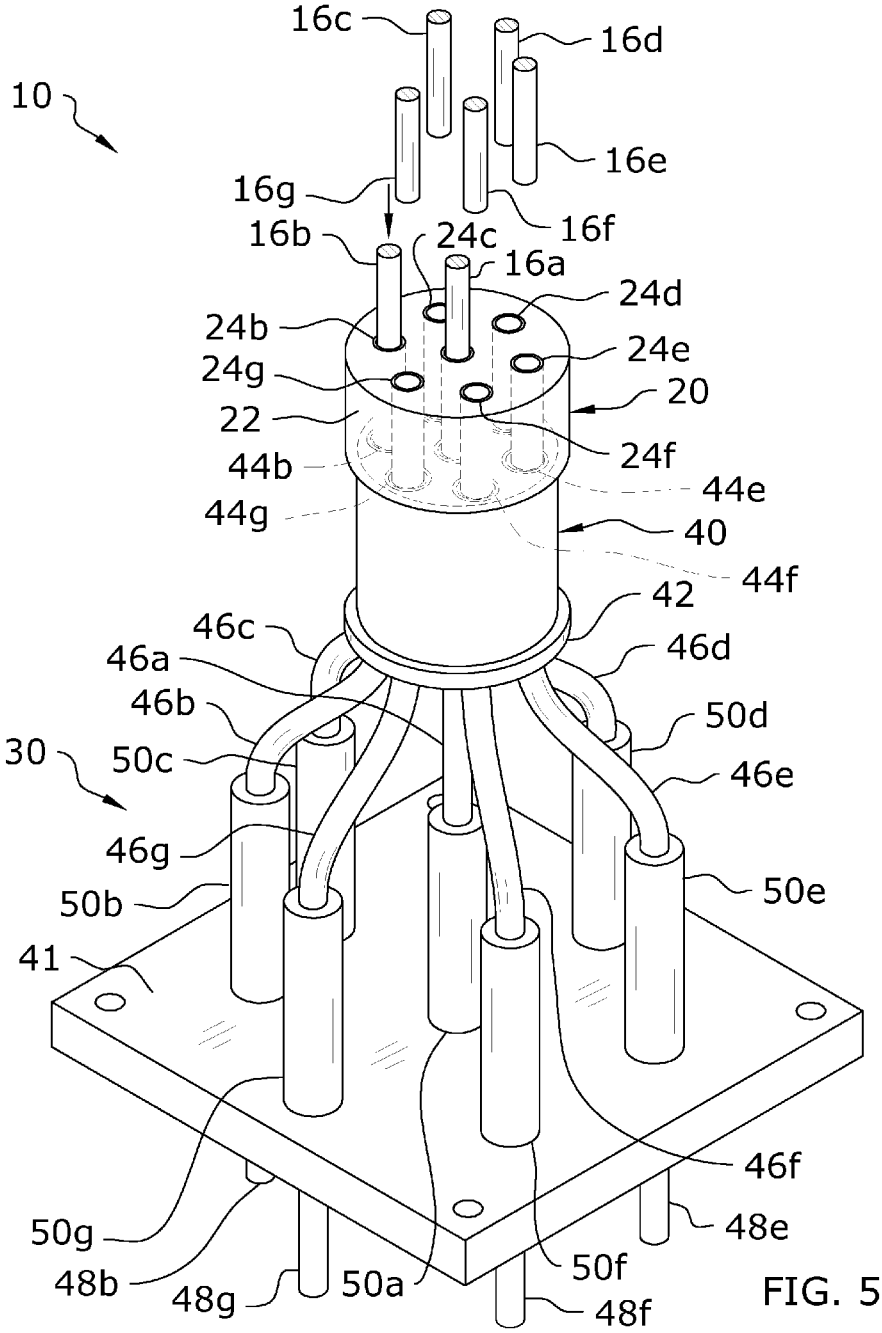
FIG. 5*c* is an upper perspective view of the electrical connector positioned upon the heat unit with a second wire inserted into a second connector receptacle.
Figure 5D:
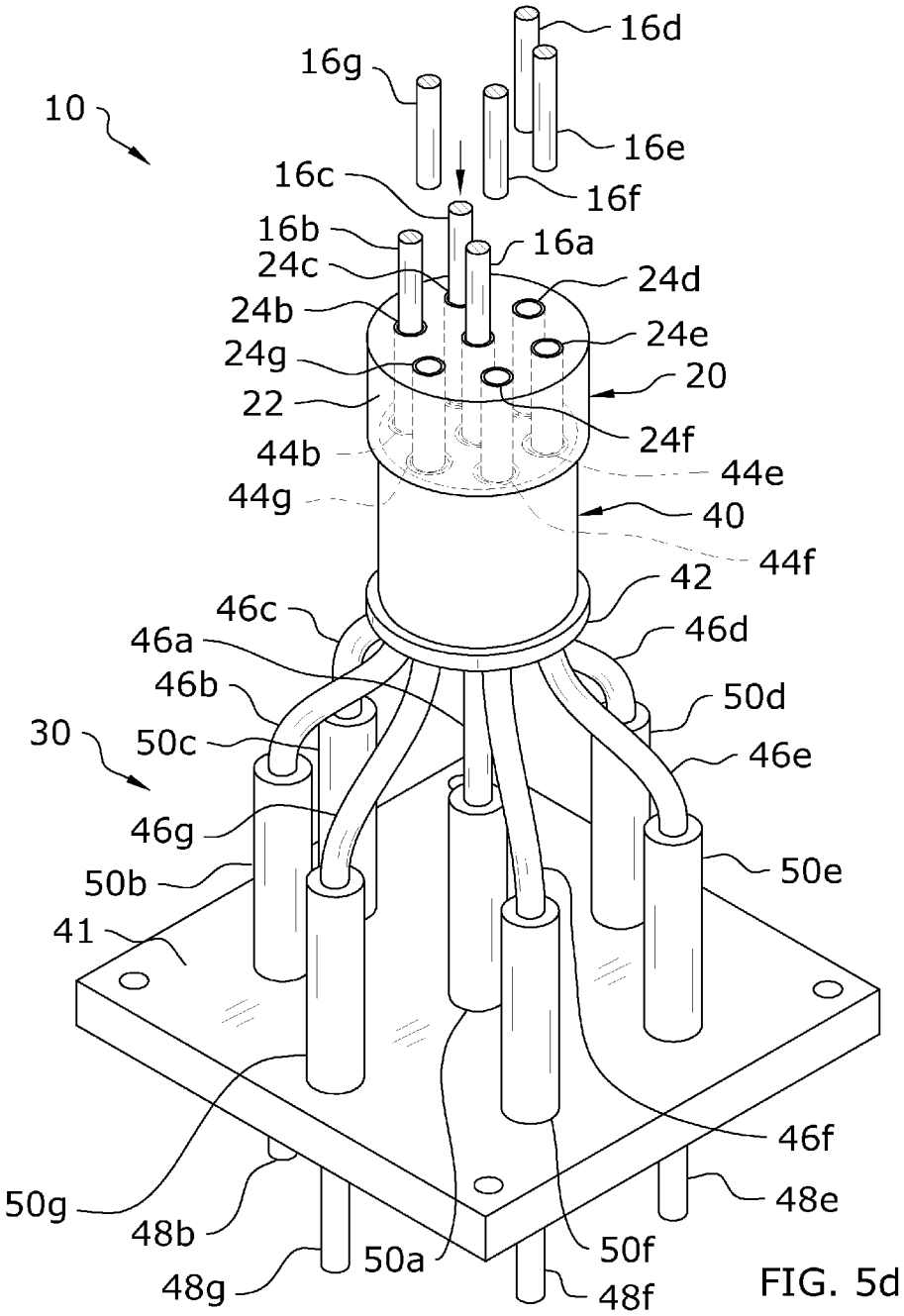
FIG. 5*d* is an upper perspective view of the electrical connector positioned upon the heat unit with a third wire inserted into a third connector receptacle.
Figure 5E:
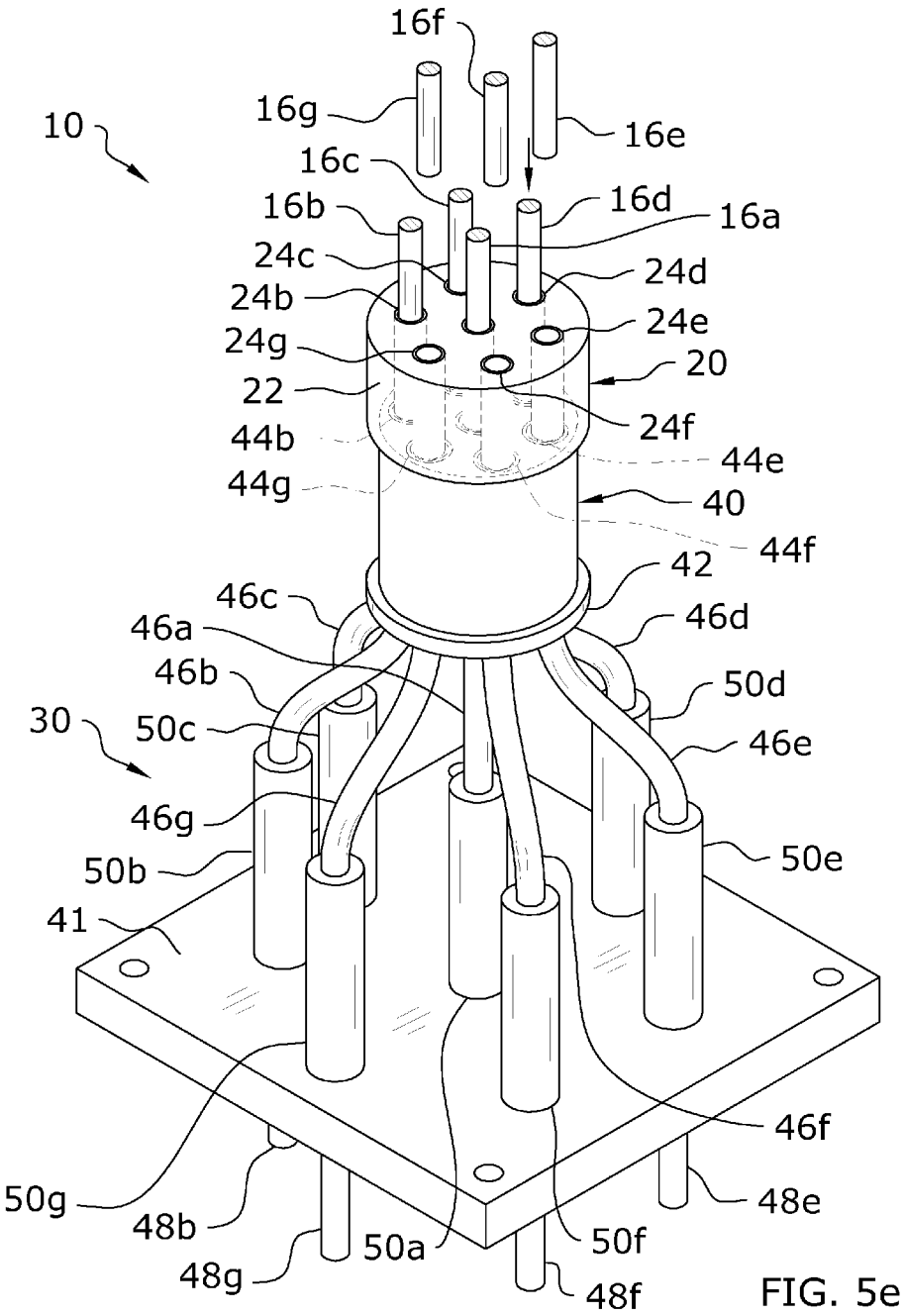
FIG. 5*e* is an upper perspective view of the electrical connector positioned upon the heat unit with a fourth wire inserted into a fourth connector receptacle.
Figure 5F:
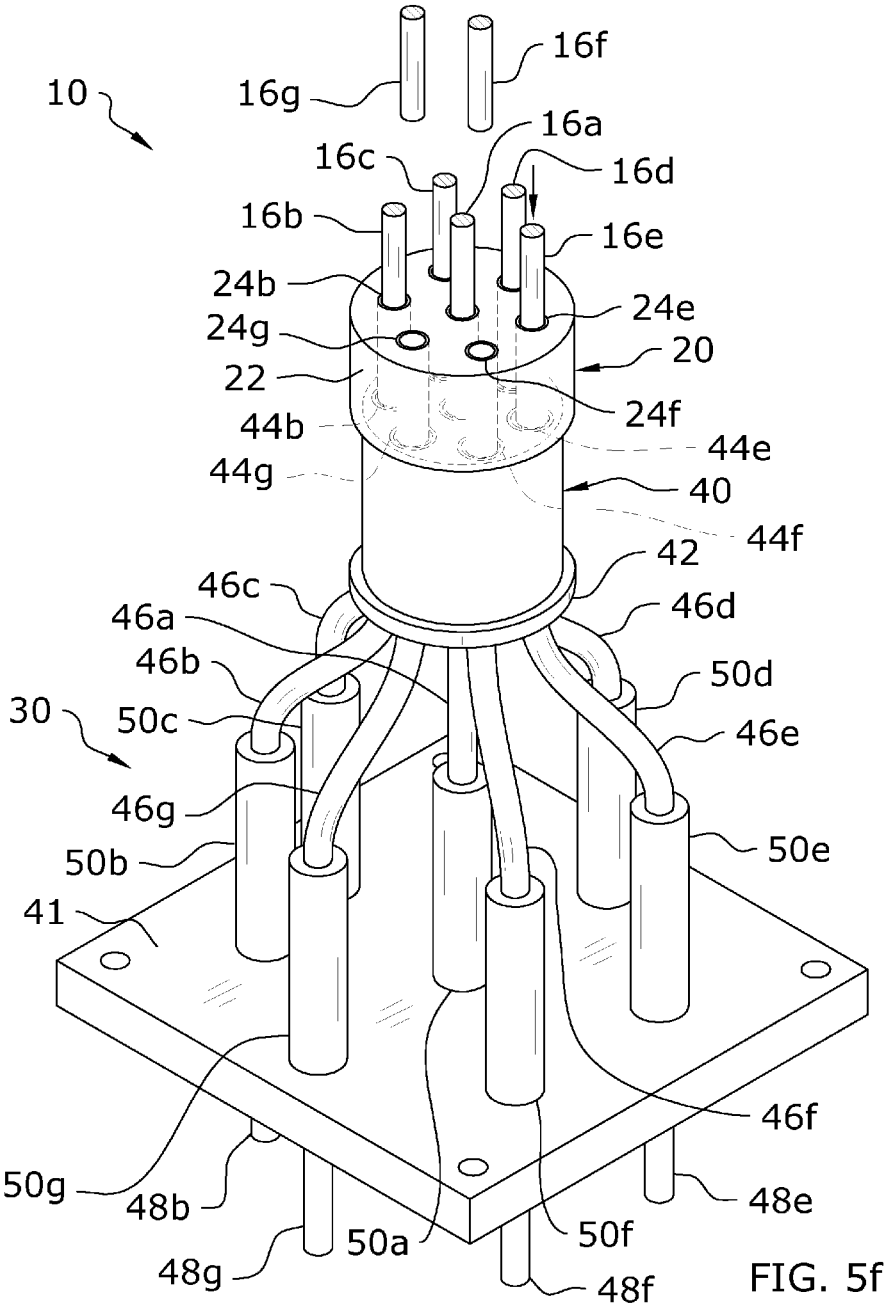
FIG. 5*f* is an upper perspective view of the electrical connector positioned upon the heat unit with a fifth wire inserted into a fifth connector receptacle.
Figure 5G:
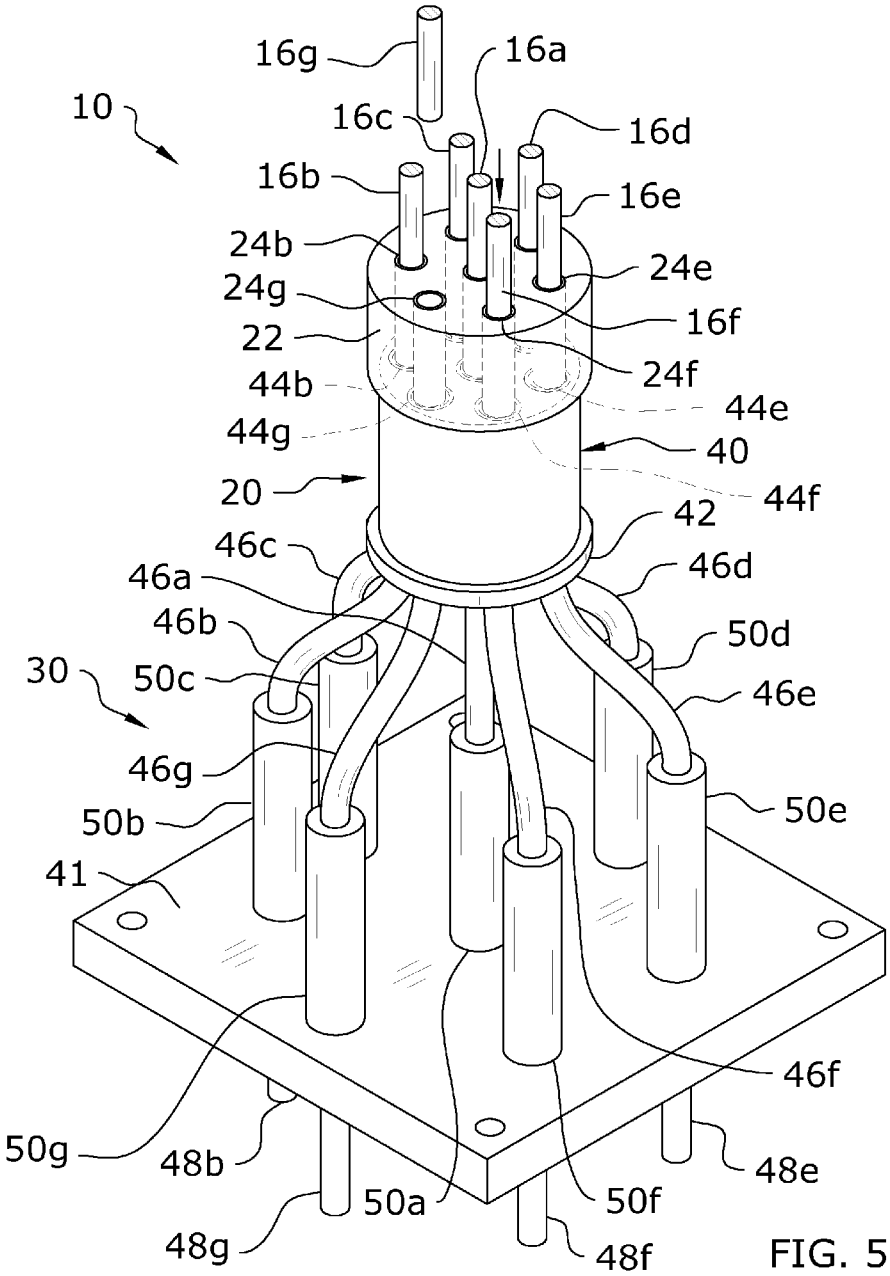
FIG. 5*g* is an upper perspective view of the electrical connector positioned upon the heat unit with a sixth wire inserted into a sixth connector receptacle.
Figure 5H:
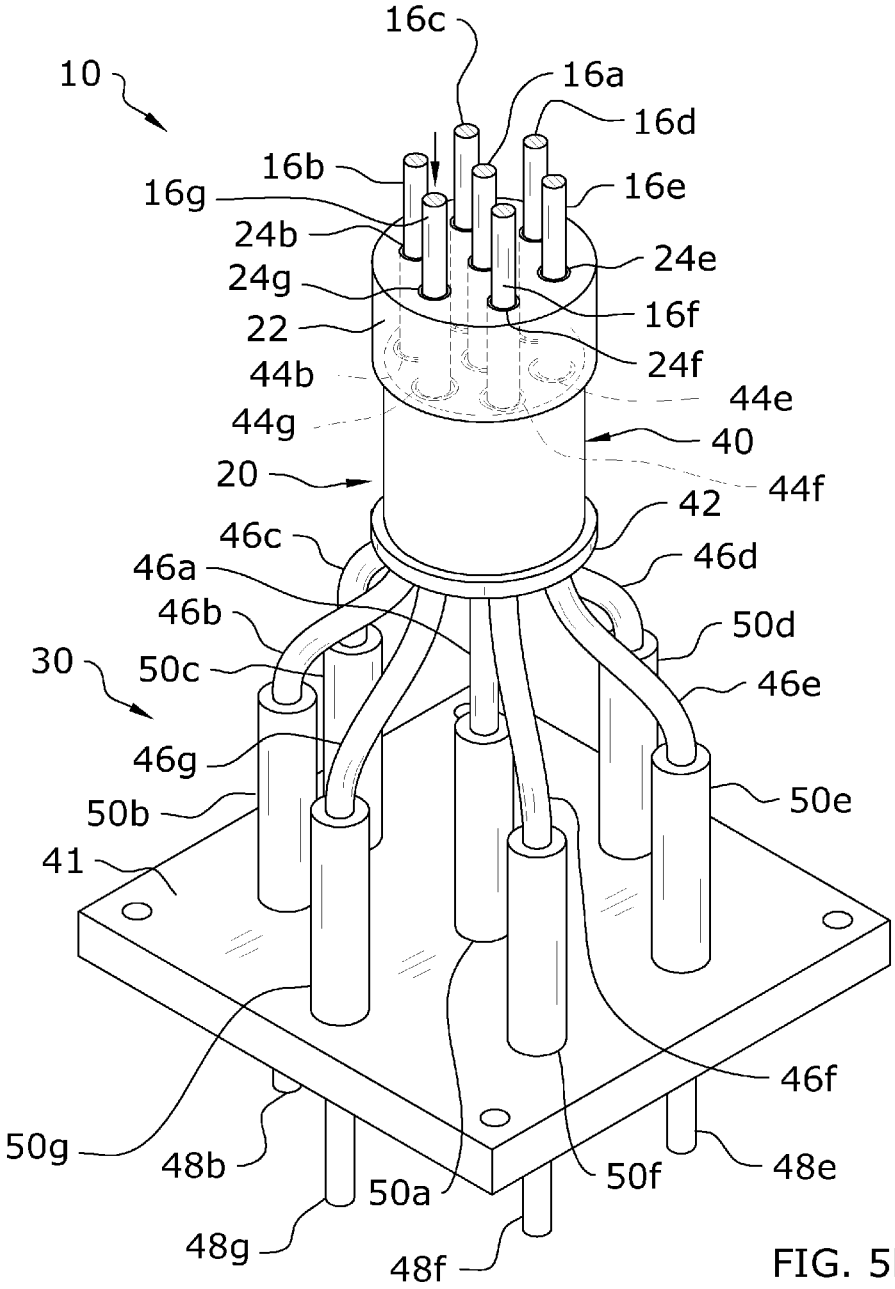
FIG. 5*h* is an upper perspective view of the electrical connector positioned upon the heat unit with a seventh wire inserted into a seventh connector receptacle.
Figure 6:
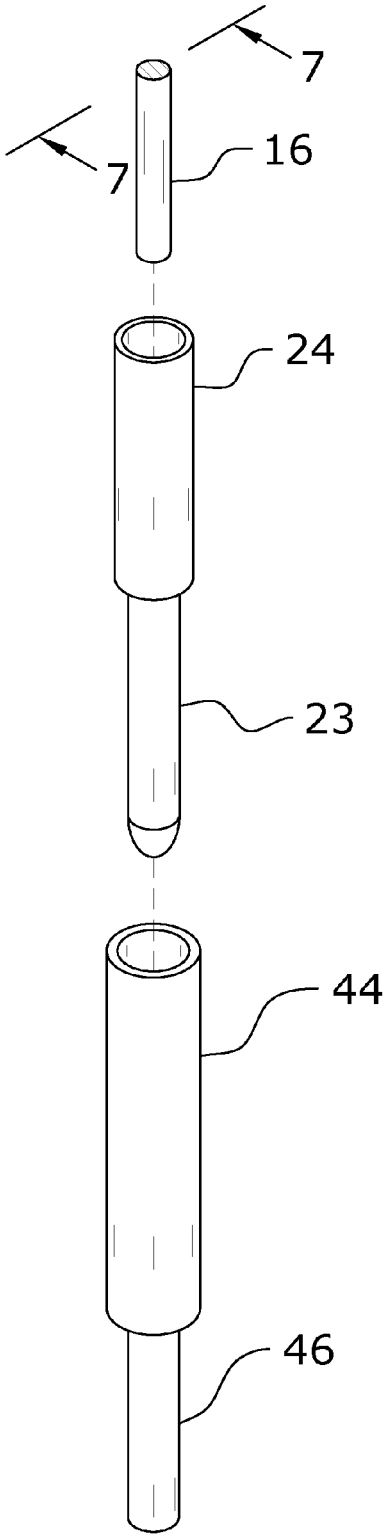
FIG. 6 is an exploded upper perspective view of a wire with respect to a connector pin and a heat receptacle.
Figure 7:
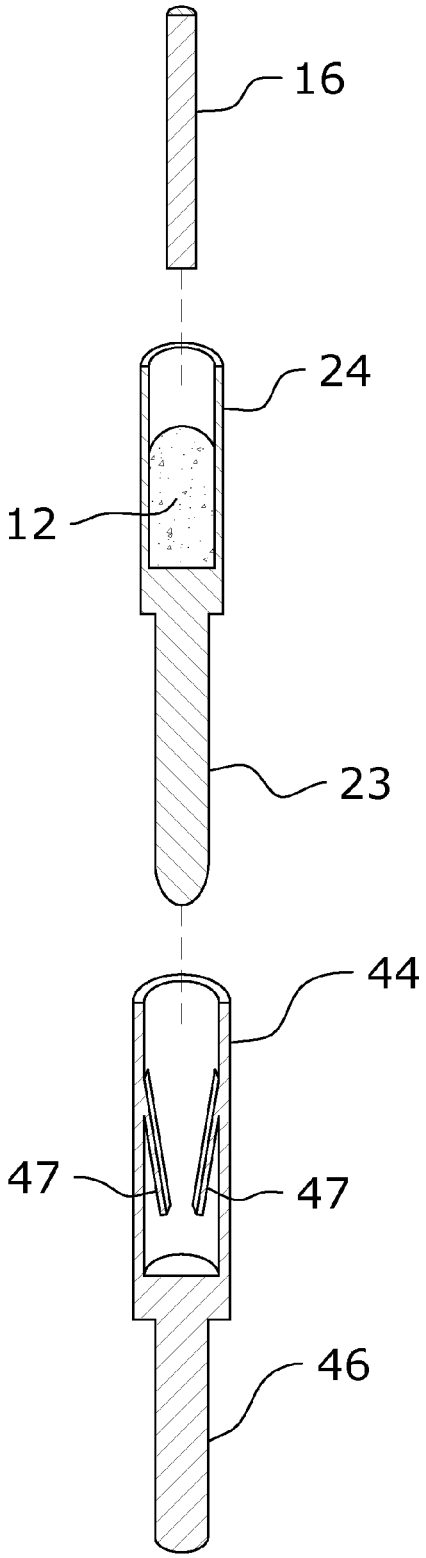
FIG. 7 is an exploded upper perspective cutaway view of FIG. 6 showing the solder within the connector receptacle of the connector pin.
Figure 8A:
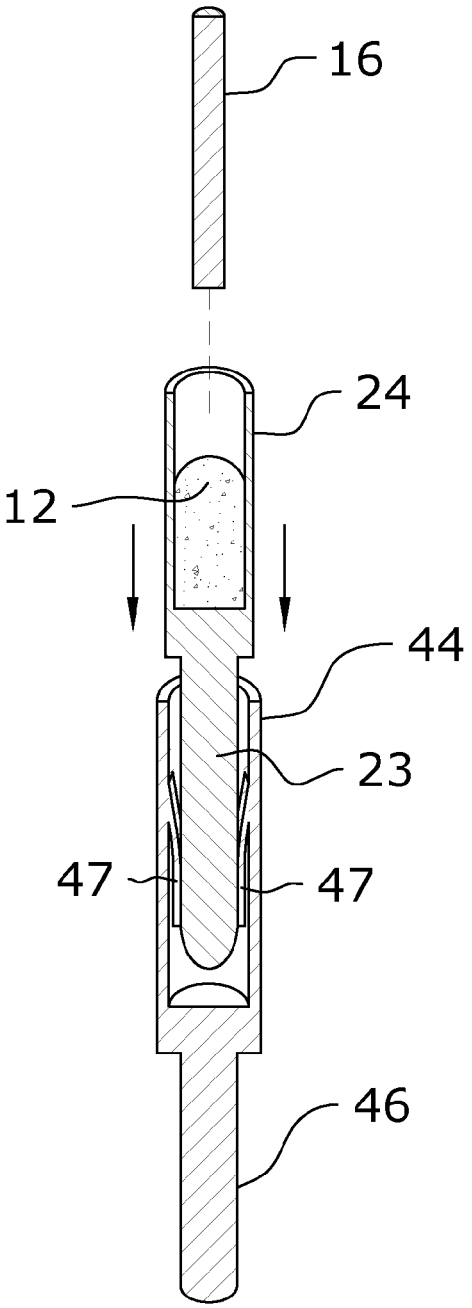
FIG. 8*a* is an upper perspective cutaway view of the connector pin positioned within the heat receptacle to melt the solder.
Figure 8B:
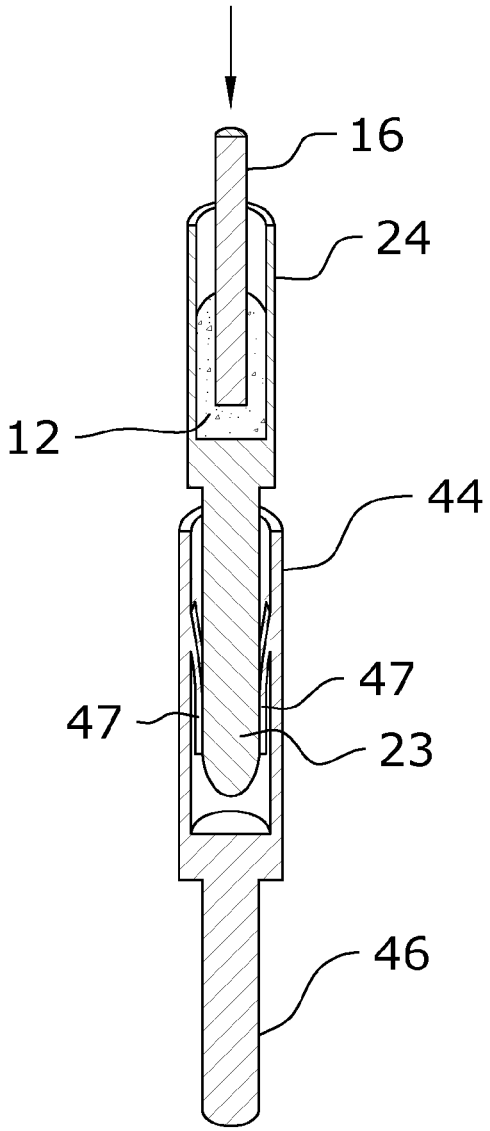
FIG. 8*b* is an upper perspective cutaway view of the wire inserted into the connector receptacle and the melted solder.
Figure 8C:
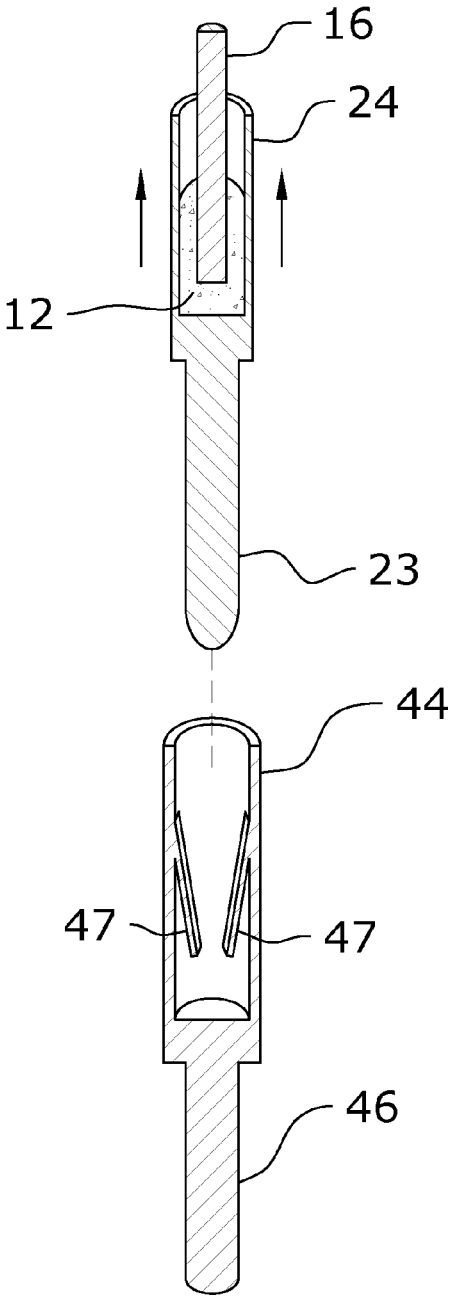
FIG. 8*c* is an upper perspective cutaway view of the wire connected within the connector pin and the connector pin removed from the heat receptacle.

Heat is first applied to the first connector pin 23*a* of the plurality of connector pins 23*a-g* by the heat applicator device 30 thereby melting a first solder 12 within a first connector receptacle 24*a* of the first connector pin 23*a*. The technician then inserts a first wire 16*a* of the plurality of wires 16*a-g* into the first connector receptacle 24*a* and the melted solder 12 as illustrated in FIG. 5*b* of the drawings. The heat is removed from the first connector pin 23*a* thereby allowing the first solder 12 to harden thereby physically securing and electrically coupling the first wire 16*a* within the first connector receptacle 24*a*. Heat is then applied to the second connector pin 23*b* of the plurality of connector pins 23*a-g* by the heat applicator device 30 thereby melting a second solder 12 within a second connector receptacle 24*b* of the second connector pin 23*b*. The technician then inserts a second wire 16*b* of the plurality of wires 16*a-g* into the second connector receptacle 24*b* and the melted solder 12 as illustrated in Figure Sc of the drawings. The heat is removed from the second connector pin 23*b* thereby allowing the second solder 12 to harden thereby physically securing and electrically coupling the second wire 16*b* within the second connector receptacle 24*b*. The above process of heating a connector pin and inserting a corresponding wire is repeated until all of the wires 16*a-g* are soldered to their respective connector receptacles 24*a-g* as illustrated in FIGS. 5*c* through 5*h* and 17 of the drawings. The heat applicator device 30 is not moved relative to the electrical connector 20 during or between the application of heat to the first connector pin or subsequent connector pins 23*a-g*.

To further illustrate the operation of the present invention as shown in FIG. 1*a* of the drawings, the technician moves the control switch 34 to position 1 after positioning the electrical connector 20 within the heating unit 40. When the control switch 34 is in position 1, the first heating element 48*a* is activated thereby heating the first thermal connector 50*a* which thereby heats the first heat conductor 46*a* which thereby heats the first heat receptacle 44*a* which thereby heats the first connector pin 23*a*. When the first connector pin 23*a* is heated, the heat is conducted through the length of the first connector pin 23*a* upwardly to the first connector receptacle 24*a* thereby melting the first solder 12 within the first connector receptacle 24*a*. The first wire 16*a* is inserted into the first connector receptacle 24*a* and the liquefied first solder 12 within by the technician.

After the first wire 16*a* is properly inserted, the technician then turns the control switch 34 to position 2 which then deactivates the first heat element 48*a* thereby allowing the first solder 12 to cool and harden to retain the first wire 16*a* within the first connector receptacle 24. Also, when the control switch 34 is in position 2, the second heat element 48*b* is activated so the same process may applied for connecting the second wire 16*b* within the second connector receptacle 24*b*. When the control switch 34 is in position 2, the second heating element 48*b* is activated thereby heating the second thermal connector 50*b* which thereby heats the second heat conductor 46*b* which thereby heats the second heat receptacle 44*b* which thereby heats the second connector pin 23*b*. When the second connector pin 23*b* is heated, the heat is conducted through the length of the second connector pin 23*b* upwardly to the second connector receptacle 24*b* thereby melting the second solder 12 within the second connector receptacle 24*b*. The second wire 16*b* is inserted into the second connector receptacle 24*b* and the liquefied second solder 12 within by the technician.

This process continues with position 3 for the third wire 16*c*, the fourth wire 16*d*, the fifth wire 16*e*, the sixth wire 16*f* and the seventh wire 16*g* until all of the wires 16*a-g* are properly terminated within the electrical connector 20. After the wires 16*a-g* are properly terminated within the electrical connector 20, the electrical connector 20 is removed from the heating unit 40 of the heat applicator device 30 and then tested to ensure that the wires 16*a-g* are connected according to the proper pinout.

It is preferable that heat is applied to the connector pins 23*a-g* to the portion (the male connecting portion) of the connector pins 23*a-g* extending outwardly from the first side of the electrical connector 20 opposite of the connector receptacles 24*a-g* and wherein heat is not applied directly to the connector receptacles 24*a-g* by the heat applicator device 30 (i.e. the heat is conducted from the male connecting portion of the connector pins 23*a-g* upwardly through to the connector receptacles 24*a-g*). In addition, it is preferable that the control unit 60 notifies the technician that a specific wire is ready to be inserted into a corresponding connector receptacle after a period of time or other condition is sensed (e.g. temperature of the heating element or heat receptacle). It is further preferable that notification of the technician includes visually indicating on the display unit 62 where the selected connector pin is located on the electrical connector 20 for the wire to be inserted into. It is further preferable that all of the steps of soldering the wires 16*a-g* to the electrical connector 20 occur without utilizing a soldering hand tool (e.g. a soldering gun or soldering iron).

Any and all headings are for convenience only and have no limiting effect. Unless otherwise defined, all technical and scientific terms used herein have the same meaning as commonly understood by one of ordinary skill in the art to which this invention belongs. Although specific terms are employed herein, they are used in a generic and descriptive sense only and not for purposes of limitation. All publications, patent applications, patents, and other references mentioned herein are incorporated by reference in their entirety to the extent allowed by applicable law and regulations.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs), DVDs (digital video discs), and computer instruction signals embodied in a transmission medium (with or without a carrier wave upon which the signals are modulated). For example, the transmission medium may include a telecommunications network, such as the Internet.

The invention is described above with reference to block and flow diagrams of systems, methods, apparatuses, and/or computer program products according to example embodiments of the invention. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, or may not necessarily need to be performed at all, according to some embodiments of the invention. These computer-executable program instructions may be loaded onto a general-purpose computer, a special-purpose computer, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the invention may provide for a computer program product, comprising a computer usable medium having a computer-readable program code or program instructions embodied therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks. Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

The present invention may be embodied in other specific forms without departing from the spirit or essential attributes thereof, and it is therefore desired that the present embodiment be considered in all respects as illustrative and not restrictive. Many modifications and other embodiments of the invention will come to mind to one skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although methods and materials similar to or equivalent to those described herein can be used in the practice or testing of the present invention, suitable methods and materials are described above. Thus, the present invention is not intended to be limited to the embodiments shown, but is to be accorded the widest scope consistent with the principles and features disclosed herein.

The invention claimed is:

1. A method of terminating a plurality of wires to an electrical connector, comprising:

providing a heat applicator device;

providing an electrical connector having a plurality of connector pins, wherein each of said plurality of connector pins includes a receptacle;

providing a plurality of wires to be terminated to said electrical connector;

connecting said electrical connector to said heat applicator device;

applying heat to a first connector pin of said plurality of connector pins by said heat applicator device thereby melting a first solder within a first connector receptacle of said first connector pin;

inserting a first wire of said plurality of wires into said first connector receptacle;

applying heat to a second connector pin of said plurality of connector pins by said heat applicator device thereby melting a second solder within a second connector receptacle of said second connector pin; and inserting a second wire of said plurality of wires into said second connector receptacle.

2. The method of claim 1, wherein said heat applicator device is not moved relative to said electrical connector during or between said step of applying heat to said first connector pin and said step of applying heat to said second connector pin.

3. The method of claim 1, wherein said step of connecting said electrical connector to said heat applicator device is comprised of positioning said plurality of connector pins within a plurality of heat receptacles within a heating unit of said heat applicator device.

4. The method of claim 3, wherein said electrical connector remains stationary within said heating unit during and between applying heat to said plurality of connector pins.

5. The method of claim 3, wherein said plurality of heat receptacles are each concentrically aligned with a corresponding connector pin of said plurality of connector pins.

6. The method of claim 3, wherein said step of applying heat to said first connector pin is comprised of heating a first heat receptacle of said plurality of heat receptacles and wherein said step of applying heat to said second connector pin is comprised of heating a second heat receptacle of said plurality of heat receptacles.

7. The method of claim 3, wherein said electrical connector includes an insulator housing having a first side and a second side, wherein said first side is opposite of said second side, wherein said plurality of connector pins extend through said insulator housing outwardly from said first side of said insulator housing, wherein said first connector receptacle and said second connector receptacle extend outwardly from said second side.

8. The method of claim 1, wherein said step of applying heat to said first connector pin comprises applying heat to a portion of said first connector pin extending outwardly from a first side of said electrical connector and wherein said first connector receptacle extends from a second side of said electrical connector, wherein said second side is opposite of said first side.

9. The method of claim 8, wherein said heat is not applied directly to said first connector receptacle by said heat applicator device.

10. The method of claim 1, wherein said first connector receptacle and said second connector receptacle are tubular.

11. The method of claim 10, wherein said first connector receptacle is prefilled with said first solder and said second connector receptacle is prefilled with said second solder prior to said step of applying heat to said first connector pin.

12. The method of claim 10, wherein said first connector receptacle is prefilled with said first solder and said second connector receptacle is prefilled with said second solder prior to said step of connecting said electrical connector.

13. The method of claim 1, wherein said steps of inserting said first wire and inserting said second wire are performed manually by a technician.

14. The method of claim 13, including the step of notifying said technician to perform said step of inserting said first wire after said step of applying heat to said first connector pin is started.

15. The method of claim 14, wherein said step of notifying said technician comprises visually indicating on a display unit where said first connector pin is located on said electrical connector.

16. The method of claim 13, wherein said steps of applying heat to said first connector pin and applying heat to said second connector pin are performed without utilizing a soldering hand tool.

17. The method of claim 1, further comprising a step of removing heat from said first connector pin after said step of inserting said first wire of said plurality of wires into said first connector receptacle.

18. The method of claim 1, wherein said heat applicator device includes a control unit, wherein said control unit activates a first heat element that heats a first heat receptacle within said heat applicator device during said step of applying heat to a first connector pin and wherein said control unit activates a second heat element that heats a second heat receptacle within said heat applicator device during said step of applying heat to said second connector pin.

19. The method of claim 18, wherein said control unit automatically activates said first heat element and said second heat element.

20. The method of claim 18, wherein said control unit includes a control switch having a first position and a second position, wherein when said control switch is in said first position, said first heat element is activated with said second heat element deactivated and wherein when said control switch is in said second position, said second heat element is activated with said first heat element deactivated.

* * * * *